US005588762A

United States Patent [19]

Suzuki

[11] Patent Number: 5,588,762

[45] Date of Patent: Dec. 31, 1996

[54] PAPER DISCHARGE APPARATUS

[75] Inventor: Kanji Suzuki, Shizuoka, Japan

[73] Assignee: Star Micronics Co., Ltd., Shizuoka-ken, Japan

[21] Appl. No.: 592,863

[22] Filed: Jan. 24, 1996

[30] Foreign Application Priority Data

Feb. 1, 1995 [JP] Japan ..... 7-037595
Jul. 28, 1995 [JP] Japan ..... 7-212913

[51] Int. Cl.[6] ..... B41J 11/42

[52] U.S. Cl. ..... 400/582; 400/593; 400/621; 400/708

[58] Field of Search ..... 400/582, 592, 400/593, 596, 603, 621, 636, 161, 708, 279

[56] References Cited

U.S. PATENT DOCUMENTS

| | | | |
|---|---|---|---|
| 4,449,835 | 5/1984 | Arai | 400/161 |
| 4,639,739 | 1/1987 | Tsutsumi | 400/621 |
| 4,663,638 | 5/1987 | Hirose | 400/621 |
| 4,679,953 | 7/1987 | Sone et al. | 400/708 |
| 4,878,428 | 11/1989 | Watarai | 400/708 |
| 5,041,845 | 8/1991 | Ohkubo et al. | 400/621 |
| 5,133,615 | 7/1992 | Saito et al. | 400/621 |
| 5,215,393 | 6/1993 | Wincent . | |
| 5,241,331 | 9/1993 | Chiku | 400/636 |
| 5,328,281 | 7/1994 | Narita | 400/708 |
| 5,478,161 | 12/1995 | Suzuki et al. | 400/621 |

*Primary Examiner*—John S. Hilten
*Attorney, Agent, or Firm*—Pollock, Vande Sande & Priddy

[57] ABSTRACT

The present invention provides a paper discharge apparatus for collecting a remaining paper which the recipient rejects or forgets to receive so as to facilitate stable paper discharge. The paper discharge apparatus for discharging an arbitrarily cut paper from a paper discharge port comprising a paper feed means for feeding the paper, a paper discharge means for discharging the paper to the paper discharge port, a paper storage means for bending and storing the paper in the apparatus by operating the paper feed means alone while stopping discharging operation of the paper discharge means when the paper fed by the paper feed means is delivered to the paper discharge means in a paper discharge mode, and a paper collection means for collecting the paper in the apparatus when the paper discharged to the paper discharge port is not removed during a given time. The paper discharge apparatus with this structure enhances reliability of the paper discharging operation, and enables continuous and stable paper discharging operation by preventing a discharged paper from being left in the apparatus so as to eliminate a possible obstruction of a succeeding operation.

11 Claims, 22 Drawing Sheets

PAPER DISCHARGE APPARATUS

BACKGROUND OF THE INVENTION

1. Field of the Invention

The present invention relates to a paper discharge apparatus for use in an issuing apparatus for issuing a receipt, a ticket, etc. using a roll paper and for discharging a cut continuous paper.

2. Description of the Prior Art

There have been conventionally installed a cash dispenser and an information terminal apparatus in an unmanned shop where an issuing apparatus is installed as a conversation means with a customer for issuing a receipt or a ticket on which necessary information is printed. A small sized printer is used in such an issuing apparatus which performs a paper discharging operation while performing a printing operation, and the paper forming the receipt or the ticket is cut off by an auto cutter in a given length upon completion of the printing operation.

FIG. 20A shows an external appearance of the conventional printer. A paper discharge port 306 is provided at a front surface panel portion 304 of an outer casing 302. A continuous paper 308 is discharged from the paper discharge port 306 depending on the printing operation. A recipient can receive the discharged paper 308 while picking it up with fingers.

FIG. 20B shows an internal structure of the conventional printer. There is formed a paper feed passage 310 which extends from the interior of the outer casing 302 to the paper discharge port 306. A paper feed mechanism 312, a print mechanism 314 and a cutter mechanism 316 are respectively provided along the paper feed passage 310. The paper feed mechanism 312 is a means for feeding the paper 308 in synchronization with a printing operation. The paper feed mechanism 312 is provided with a pair of feed rollers 318 and 320. The paper 308 is guided between and clamped by the feed rollers 318 and 320 and fed out by the rotation of the feed rollers 318 and 320 while it is pressed by and brought into contact with the feed rollers 318 and 320. The print mechanism 314 comprises a print head 322 and a platen 324 which are confronted to each other while interposing the paper feed passage 310 therebetween. When the print head 322 is driven, the paper 308 is printed. Printing form is varied depending on the kind of the paper 308. If a heat sensitive paper is used, an ink ribbon is not needed while if an ordinary paper is used, a color medium such as the ink ribbon is needed. The cutter mechanism 316 is composed of an independent unit and contains therein a cutter blade 326 which slides in the direction perpendicular to the feeding direction of the paper 308. The cutter blade 326 is driven by a slide driving mechanism. In the cutter mechanism 316, when the cutter blade 326 slides downward in FIG. 20B, the fed paper 308 is cut off.

In such a printer, the paper 308 is discharged from the paper discharge port 306 while it is printed. Upon completion of the printing operation, the paper 308 is discharged continuously by a given amount and cut off by the cutter blade 326 when the cutter blade 326 slides.

If such a printer is employed by the issuing apparatus for issuing the receipt or the ticket, it is expected that a recipient stands by for completion of the printing operation while picking up an end of the paper 308 with fingers. It is also expected that the recipient obstructs the discharge of the paper 308. FIG. 21 shows an example of a case where the recipient stands by for the issuance of the paper 308. That is, when the recipient stands by while picking up the paper 308, the paper 308 is prevented from being smoothly fed so that the paper 308, while it is fed on the paper feed passage 310, is liable to generate bending 328. The bending 328 gives unnecessary stress to the paper 308 in the direction opposite to the discharge direction of the paper 308. As a result, the paper 308 is bent inside the printer and a normal discharge operation can not be performed, which causes a paper jam.

FIG. 22A shows a case where the recipient forcibly pulls out the paper 308 to be discharged. If tension T is applied to the paper 308, the tension T applies unnecessary load to an edge 330 of the cutter blade 326 in the direction perpendicular to the sliding direction F as shown in FIG. 22B. If the load is extremely large, the edge 330 of the cutter blade 326 is damaged. If the edge 330 is bent, there occurs a possibility that the cutter blade 326 can not slide or a cutting operation is deteriorated.

In such a conventional printer, there is provided a means to prevent the recipient from touching the paper 308 until the paper 308 having a predetermined length is completely discharged. For example, such a printer is disclosed in JP-U No. 5-29765. In this printer, a cover having a depth corresponding to the length of the paper 308 to be issued is attached to a paper discharge portion, and the paper 308 is guided within the cover to prevent the recipient from touching the paper 308 and the paper 308 can be discharged from the cover only when the paper 308 is cut off.

However, such a printer has the following problems. Since the cover protrudes from the printer, the cover per se is liable to be damaged. Furthermore, since the size of the cover corresponds to the length of the paper 308, if the length of the paper 308 to be issued is changed, it must be changed to correspond to the changed length of the paper 308, which makes the issuing apparatus large.

There have been proposed paper discharge apparatuses as a means for coping with the aforementioned problems as disclosed in JP-A No. 1-181659 and U.S. Pat. No. 5,215,393. In such apparatuses, the paper is slackened and standby in the discharge passage until the printing operation is completed, thereby preventing the recipient from receiving the paper, and the paper is cut off and discharged from a discharge port upon completion of the printing operation.

SUMMARY OF THE INVENTION

In the conventional paper discharge apparatus, in the case that the recipient rejects or forgets to receive the paper such as a receipt, or a ticket and leaves the apparatus, the paper remaining in the apparatus causes an obstruction of succeeding issuance of the paper, particularly, in an unmanned shop where the remaining paper cannot be manually removed.

Accordingly, it is an object of the present invention to provide a paper discharge apparatus that realizes the stability of a paper discharging operation by collecting the paper remaining in the apparatus when a recipient rejects or forgets to receive.

That is, in a first aspect of the invention, a paper discharge apparatus for discharging an arbitrarily cut paper (2) from a paper discharge port (68), as exemplified in FIGS. 1 through 16, wherein the paper discharge apparatus is characterized by comprising a paper discharge means (paper discharge/collection mechanism 28) for discharging the paper to the discharge port and a collecting means (paper discharge/collection mechanism 28) for collecting the paper in the apparatus when the paper discharged to the discharge port is not removed.

That is, the paper discharge apparatus of the first aspect of the invention is, as exemplified in FIGS. 1 through 16, the one for discharging the arbitrary cut paper (2) from the paper discharge port 68 comprised of a paper feed means (paper feed mechanism 10) for feeding the paper, the paper discharge means (paper discharge/collection mechanism 28) provided with paper discharge rollers (70, 72) for discharging the paper fed by the paper feed means to the paper discharge port (68), a paper storage means (paper discharge/collection mechanism 28 and paper storage portion 66) for bending and storing the paper in the apparatus by operating the paper feed means alone while stopping the discharging operation of the paper discharge means when the paper fed by the paper feed means is delivered to the paper discharge means in a paper discharge mode, and a paper collection means (paper discharge/collection mechanism 28) for collecting the paper in the apparatus when the paper discharged to the paper discharge port by the paper discharge means after the paper is stored in the paper storage means is not removed.

This paper discharge apparatus is used for cutting off a paper which is printed immediately before it is discharged or previously printed and discharging the cut paper. The paper discharge means is provided for discharging the paper from the paper discharge port so that a recipient can receive the paper. Each operation such as a printing operation and a cutting operation is needed for discharging the paper forming the receipt or the ticket. Accordingly, only the paper feeding operation is performed while the paper discharging operation is stopped during each operation such as the printing operation and the cutting operation, whereby the bent paper is stored in the apparatus. As a result, the reliability of each operation such as the printing operation, cutting operation, etc. is enhanced. That is, the paper is stored in the apparatus until each operation such as the printing operation, cutting operation, etc. is completed. After the storing process, when the paper discharged from the paper discharge port is not removed, namely, when the recipient rejects or forgets to receive the paper, the discharged paper is collected in the apparatus. As a result, the paper is removed from a paper discharge passage, thereby avoiding the blockage of the succeeding issuance of the paper.

In a second aspect of the invention, a paper discharge apparatus is characterized in that the paper collection means performs a collecting operation for collecting the paper in the apparatus by reversely rotating the paper discharge rollers of the paper discharge means when a given time elapses upon completion of the paper discharging operation by the paper discharge means. In the paper discharge apparatus of the second aspect of the invention, when a given time elapses upon completion of the paper discharging operation by the paper discharge means, the paper collection means collects the paper in the apparatus by reversely rotating the discharge rollers. As a result, the discharged paper can be automatically collected after a given time elapses upon completion of the paper discharging operation, thereby realizing quick paper discharging and collecting operations.

In a third aspect of the invention, a paper discharge apparatus is characterized by comprising a paper detection means (paper detection sensor 84) for detecting the paper discharged to the paper discharge port by the paper discharge means, wherein the paper collection means (paper discharge/collection mechanism 28) collects the paper in the apparatus by reversely rotating the paper discharge rollers of the paper discharge means when a given time elapses upon completion of detection of the paper by the paper detection means while the paper is detected. That is, in the paper discharge apparatus of the third aspect of the invention, the paper discharged by the paper discharge means is detected by the paper detection means. The paper detecting operation can be performed at any time, for example, it may be performed when the printing operation is started, the paper discharging operation is started, and it can be based on the detection of the trailing end of the paper. Accordingly, if the paper is not removed even if a given time elapses upon completion of the detection of the paper, the discharge rollers are reversely rotated so that the paper is collected in the apparatus. The paper collecting operation is conditioned on the paper detecting operation, thereby the paper discharging operation and the paper collecting operation are successively performed with higher reliability.

In a fourth aspect of the invention, a paper discharge apparatus is characterized by comprising a paper detection means (paper detection sensor 84) for detecting a leading end of the paper discharged to the paper discharge port by the paper discharge means, wherein the paper collection means collects the paper in the apparatus by reversely rotating the paper discharge rollers of the paper discharge means when a given time elapses upon completion of detection of the leading end of the paper by the paper detection means while the paper is detected. That is, in the paper discharge apparatus of the fourth aspect of the invention, the leading end of the paper discharged to the paper discharge port is detected by the paper detection means (paper detection sensor 84). If the paper is not removed even if the given time elapses after the detection of the leading end of the paper, the paper discharge rollers are reversely rotated so that the paper is collected in the apparatus. The paper collecting operation is conditioned on the paper detecting operation, thereby the paper discharging operation and the paper collecting operation are successively performed with higher reliability.

In a fifth aspect of the invention, a paper discharge apparatus for discharging an arbitrarily cut paper from a paper discharge port is characterized by comprising a paper discharge means provided with discharge rollers for discharging the paper to the paper discharge port, a first paper detection means (paper detection sensor 84) for detecting a leading end of the paper discharged to the paper discharge port by rotation of the discharge rollers, and a second paper detection means (paper detection sensor 85) disposed at a paper storage portion (paper storage portion 66) side for detecting a trailing end of the paper discharged to the discharge port by rotation of the discharge rollers, a paper collection means (paper discharge/collection mechanism 28) for stopping the discharge rollers when the second paper detection means detects the trailing end of the paper while the paper is discharged, and for reversely rotating the discharge rollers to collect the paper in the paper discharge apparatus when a given time elapses after stoppage of the discharge rollers while the first paper detection means detects the paper. In the paper discharge apparatus of the fifth aspect of the invention, the paper discharging operation is performed by the paper discharge rollers until the second paper detection means detects the trailing end of the paper after the first paper detection means detects the discharge of the paper. As a result, the trailing end of the paper is out of the paper discharge passage to thereby surely move to the paper storage portion side, whereby the paper is positioned at a position where it can be collected. Accordingly, the paper discharging operation can be performed upon detection of the trailing end of the paper without being affected by the length of the paper, which contributes to the reliability of the paper collecting operation. The paper discharging operation is not affected by the properties of the rotary driving system of the apparatus compared with the paper discharging operation which is performed by setting the time in which there does not occur paper jams, thereby enhancing the reliability of the paper discharging operation, which results in the reliability of the paper collecting operation.

In a sixth aspect of the invention, a paper discharge apparatus of the present invention is characterized in that the paper collection means has a paper collection tray (86) under the paper discharge means so as to collect the paper which is drawn in the apparatus by the discharge rollers when they are reversely rotated and drops in the apparatus by its own weight. The paper, which is collected in the apparatus when the rollers are reversely rotated, leaves the rollers depending on the reverse rotation of the rollers and then drops in the collecting tray by its own weight. Such a paper collecting operation does not need a mechanism for feeding the collected paper, thereby simplifying the mechanism.

In a seventh aspect of the invention, the discharge port is formed over the paper discharge means. The paper to be discharged is discharged upward by the paper discharge means so that the recipient can easily receive the paper to be discharged.

In an eighth aspect of the invention, a paper discharge apparatus is characterized in that the paper discharge means comprises a pair of upper and lower paper discharge rollers, the lower discharge rollers being displaced to the paper discharge port side relative to the upper discharge rollers. Since the paper discharge rollers are displaced in such a manner, the paper can be discharged upward, and the leading end of the paper to be fed by the paper feed means can be easily clamped by the discharge rollers, thereby improving the reliability of the paper discharging operation. Further, when the paper is stored in the apparatus, the paper is easily bent, thereby preventing occurrence of the paper jam.

DETAILED DESCRIPTION OF THE PREFERRED EMBODIMENT

First Embodiment (FIGS. 1 through 16):

A paper charge apparatus according to a first embodiment of the present invention will be now described with reference to FIGS. 1 through 16.

Figure 1:
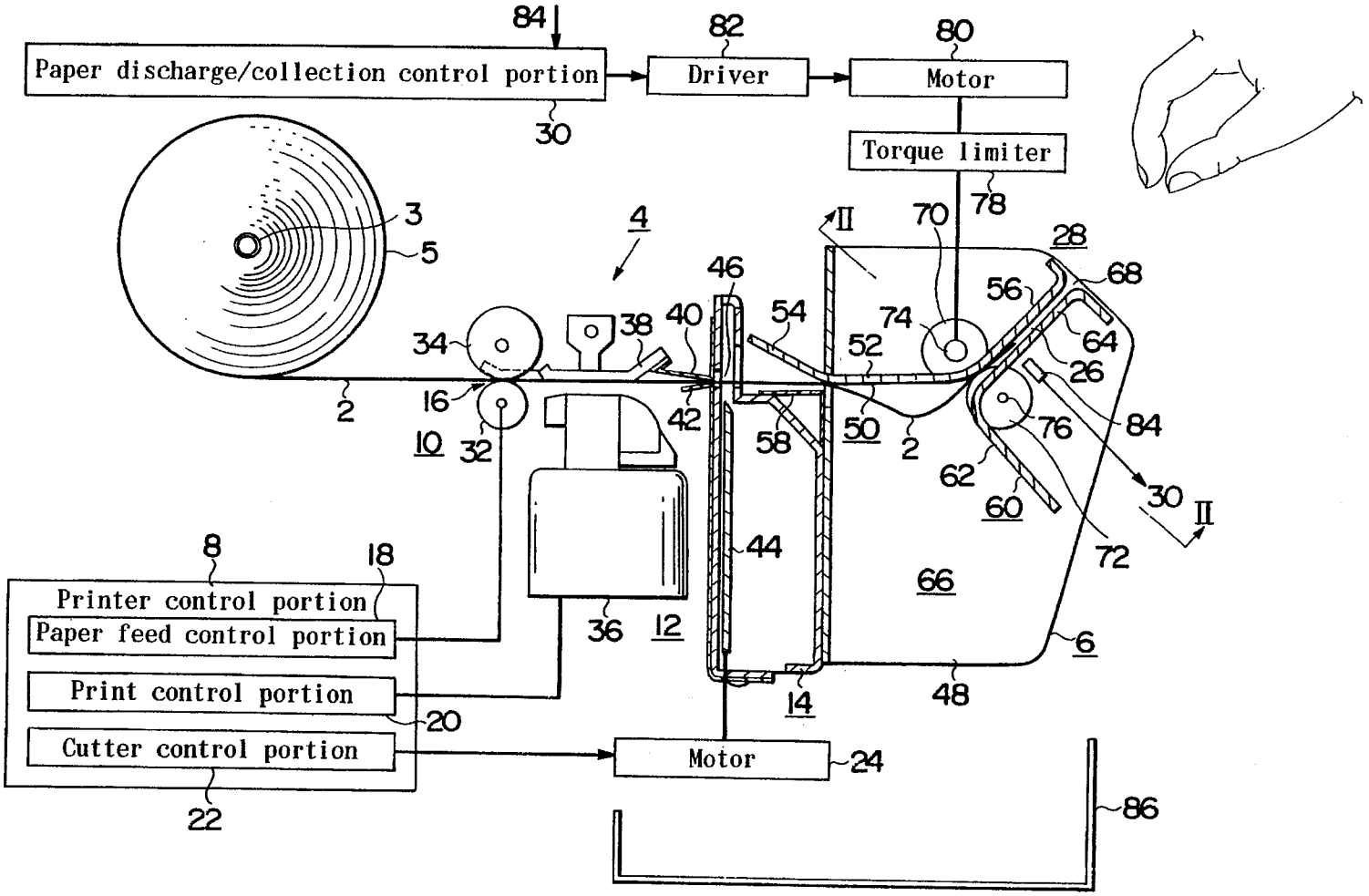
FIG. 1 is a view showing a paper discharge apparatus according to a first embodiment of the invention.

FIG. 1 shows a paper discharge apparatus according to a first embodiment of the invention. The paper discharge apparatus is, for example, structured to be integrated into a printer so as to interlock with a printing operation and a paper feeding operation. A role paper 5 wound on a winding shaft 3 is used as a paper 2.

The paper discharge apparatus comprises a paper discharge unit 6 mounted to a printer mechanism 4. The printer mechanism 4 has a printer control portion 8 serving as a control means for controlling the printing operation, the paper feeding operation and a paper discharging operation. A paper feed mechanism 10, a print mechanism 12 and a cutter mechanism 14 are respectively mounted along a paper feed passage 16.

The printer control portion 8 comprises, e.g., a microcomputer which includes a CPU, a ROM and a RAM as a memory, an I/O unit, etc. and the printer control portion 8 also includes a paper feed control portion 18, a print control portion 20, and a cutter control portion 22. The paper feed control portion 18 controls the driving of the paper feed mechanism 10, and the print control portion 20 controls the print mechanism 12, and the cutter control portion 22 controls a motor 24, thereby driving the cutter mechanism 14. A host computer serving as an external control means is connected to the printer control portion 8. Printing data, etc. are given from the host computer. The structures of these elements are the same as those of an ordinary printer.

A paper discharge passage 26 is provided in the paper discharge unit 6 for discharging the paper 2. The paper feed passage 16 and the paper discharge passage 26 are continuously disposed so as to discharge the paper 2 to be fed. There is provided a paper discharge/collection mechanism 28 serving as a paper discharge means for forcibly discharging the paper 2 and also serving as a paper collecting means for collecting the paper 2 in the apparatus. The paper discharge/collection mechanism 28 is controlled by a paper discharge/collection control portion 30 serving as a paper discharge control means to perform the paper discharging operation corresponding to the paper feed mechanism 10.

The paper feed mechanism 10 comprises a pair of feed rollers 32 and 34, in which the feed roller 32 is connected to a motor, not shown, serving as a driving means to be controlled by the paper feed control portion 18 so as to receive torque necessary for feeding the paper 2. The paper 2 clamped between the feed rollers 32 and 34 is introduced into the print mechanism 12 through the paper feed passage 16. The print mechanism 12 comprises a print head 36, a platen 38, etc., in which the paper 2 to be fed to the platen 38 is printed by the print head 36.

The cutter mechanism 14 is provided at a terminal end side of the printer mechanism 4, and paper guides 40 and 42 are mounted on the cutter mechanism 14 for receiving the paper 2 from the paper feed passage 16 at the side of the print mechanism 12. The paper guides 40 and 42 are respectively formed of an elastic plate made of a synthetic resin plate or a metallic plate, and they are opened in a given angle with respect to the print mechanism 12. A cutter blade 44 is mounted on the cutter mechanism 14 for cutting the paper 2 while sliding in a direction crossing at right angles with a feeding direction of the paper 2. When the cutter blade 44 is retracted (in case of FIG. 1), a feed passage 46 connected to the paper feed passage 16 is provided in the cutter mechanism 14, wherein the paper 2 passes through the feed passage 46 and fed to the paper discharge unit 6.

The paper discharge unit 6 has a perpendicular frame 48 on which a first discharge guide plate 50 is mounted for constituting the paper discharge passage 26 which is continuous to the paper feed passage 16. The first discharge guide plate 50 comprises a horizontal portion 52 at the center thereof, and inclination portions 54 and 56 at the front and the rear thereof. The inclination portion 54 protrudes toward the cutter mechanism 14 to prevent the paper 2 from jumping so as to easily introduce the paper 2 from the paper feed passage 16 into the paper discharge passage 26. A guide plate 58 is provided under the inclination portion 54 so as to guide the paper 2 to the horizontal portion 52.

A second discharge guide plate 60 is disposed at the inclination portion 56 side of the first discharge guide plate 50, and comprises two inclination portions 62 and 64 having an L-shape in cross section, wherein a paper storage portion 66 is formed by the inclination portion 62 and the horizontal portion 52 of the first discharge guide plate 50. The paper storage portion 66 constitutes a space portion wherein the paper 2 to be discharged, upon completion of the printing operation, is allowed to be looped and standby. The inclination portions 56 and 64 of the discharge guide plates 50 and 60 are parallel with each other, thereby constituting a closed quadrangular columnar passage, and also constituting a paper discharge port 68 at its terminal end.

The paper discharge/collection mechanism 28 is constituted together with the discharge guide plates 50 and 60 and has a pair of discharge rollers 70 and 72 at the bent portions of the discharge guide plates 50 and 60. The discharge rollers 70 are supported by a driving shaft 74 and the discharge rollers 72 are supported by a supporting shaft 76. Working surfaces of the discharge rollers 70 and 72 protrude slightly from the wall surfaces of the discharge guide plates 50 and 60 so as to facilitate clamping of the paper 2 to be fed therebetween.

Torque of a motor 80 serving as a driving means is given to the driving shaft 74 of the discharge rollers 70 by way of a torque limiter 78 serving as a discharge buffer means. The motor 80 is driven by a driver 82 to which a control output is supplied from the paper discharge/collection control portion 30 for normally rotating the motor 80 when the paper 2 is discharged or for reversely rotating the motor 80 when the paper 2 is collected.

A paper detection sensor 84 is provided at the discharge side of the discharge rollers 70 and 72 for detecting the arrival of the paper 2 wherein a detection output of the paper detection sensor 84 is supplied to the paper discharge/collection control portion 30 for controlling the driving of the discharge rollers 70. The paper detection sensor 84 employs an optical sensor, etc., wherein, for example, a light emitting element emits light to the paper 2 and a light receiving element detects the presence of light reflected on the paper 2 based on which the light receiving element detects the presence of the paper 2.

A collection tray 86 is disposed under the paper discharge unit 6 for collecting the paper 2 which is dropped from the paper storage portion 66.

Figure 2:
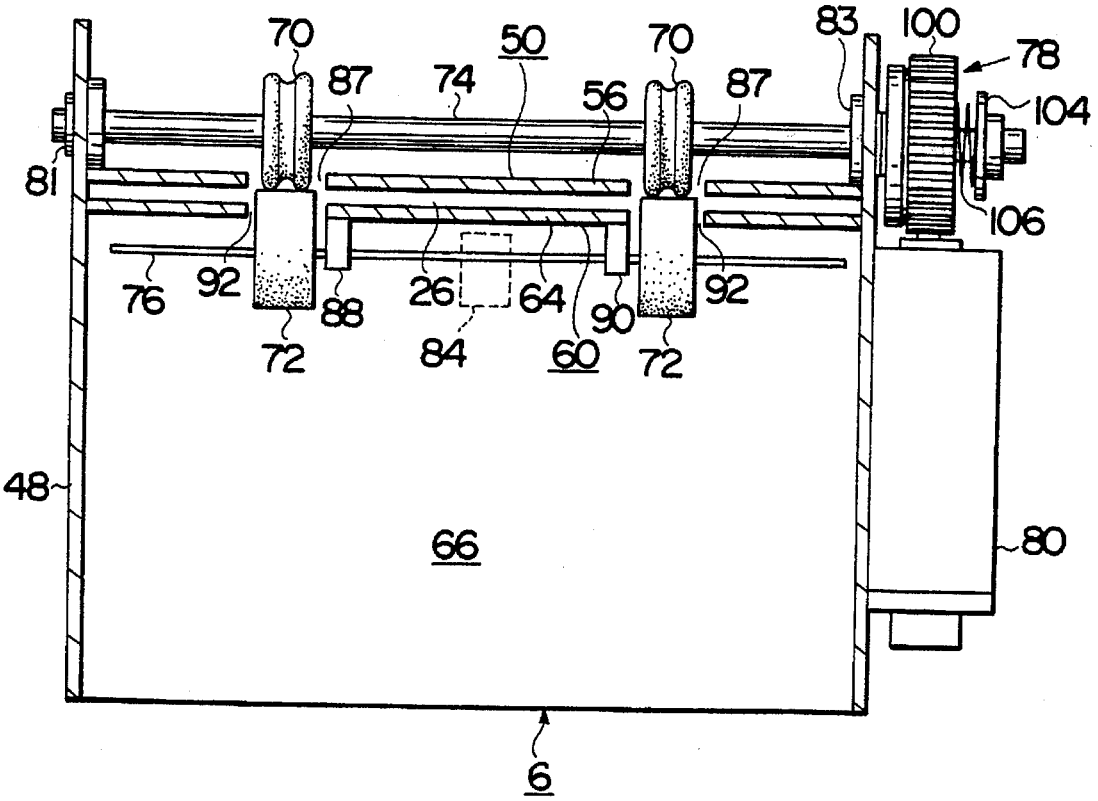
FIG. 2 is a cross-sectional view taken along line II—II of the apparatus in FIG. 1.

FIG. 2 is a cross-sectional view of the paper discharge apparatus 6 taken along II—II in FIG. 1 showing a driving system of the discharge rollers 70 and 72. Torque of the motor 80 mounted on the frame 48 is transmitted to the torque limiter 78, through which it is then transmitted to the driving shaft 74. The driving shaft 74 is supported by bearings 81 and 83 fixed to the frame 48. The pair of driving side discharge rollers 70 are mounted on the driving shaft 74 and working surfaces thereof protrude toward the paper discharge passage 26 from windows 87 of the first discharge guide plate 50. The pair of driven side discharge rollers 72 are supported by the supporting shaft 76 which is elastically supported by bearings 88 and 90 at the back side of the discharge guide plate 60. Working surfaces of the discharge rollers 72 protrude toward the paper discharge passage 26 from windows 92 provided at the discharge guide plate 60 side and elastically contact the working surfaces of the discharge rollers 70 for feeding the paper 2 while having intimate contact with the paper 2.

Figure 3:
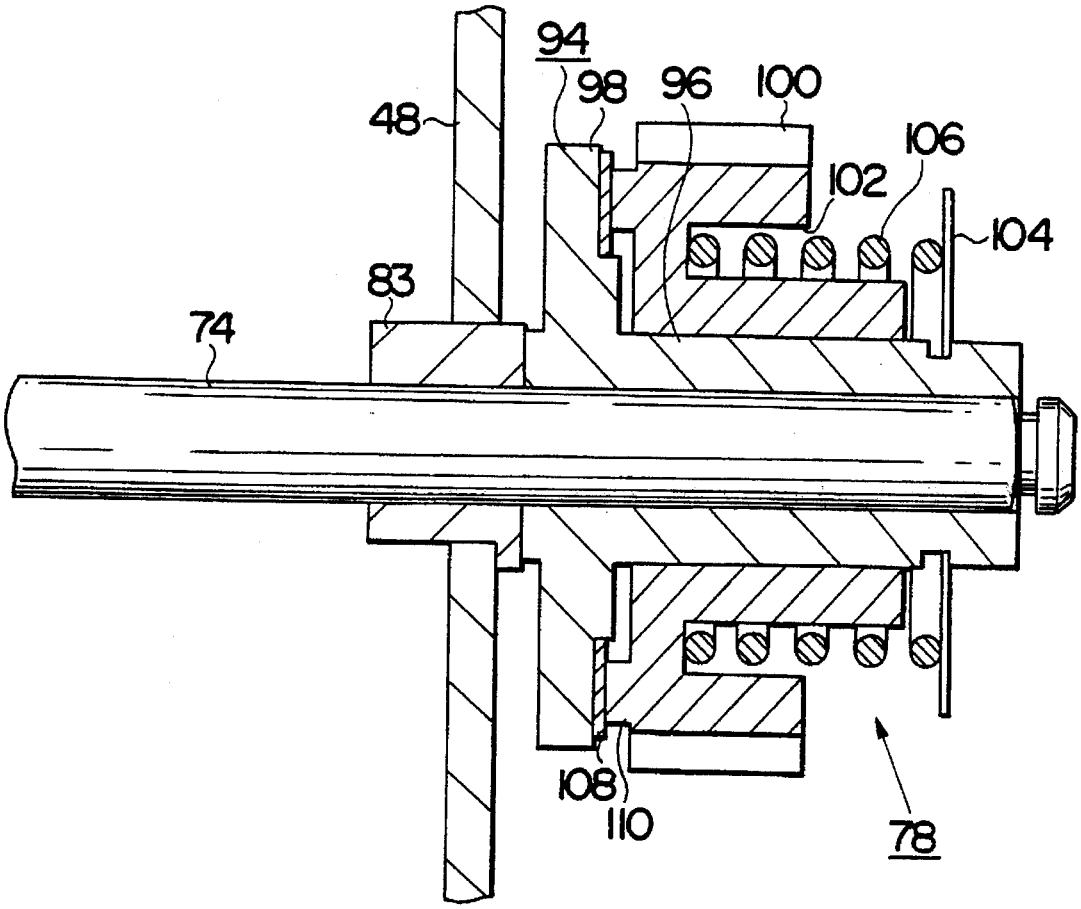
FIG. 3 is a cross-sectional view of a torque limiter.

FIG. 3 shows a concrete arrangement of the torque limiter 78. The driving shaft 74 of the discharge rollers 70 is supported by the frame 48 by way of the bearings 81 and 83 and protrudes outside the frame 48. A clutch portion 94 is fixed to the driving shaft 74 and comprises a small diameter portion 96 and a flange portion 98 wherein a gear 100 is rotatably provided on the small diameter portion 96. The gear 100 has a recessed portion 102 in its axial direction. A coil spring 106 is inserted between the recessed portion 102 and a disk-shaped spring receiver 104 which is fixed to the small diameter portion 96 of the clutch portion 94 for biasing the gear 100 to a wall surface of the flange portion 98. A slip member 108 is attached to the flange portion 98 of the clutch portion 94 and a ring-shaped contact portion 110 which is formed on the gear 100 is brought into intimate contact with the slip member 108 by pressure of the coil spring 106.

According to the torque limiter 78 having the structure as set forth above, the torque of the motor 80 is transmitted to the gear 100 by way of a gear. The clutch portion 94 is normally frictionally engaged with the gear 100 by the pressure of the coil spring 106 so that the driving force of the gear 100 is transmitted to the driving shaft 74.

Whereupon, when a force for preventing the rotation of the driving shaft 74 is applied to the driving shaft 74 by way of the discharge rollers 70, if such a force exceeds pressure by the coil spring 106 and a friction generated between the clutch portion 94 and the contact portion 110 of the gear 100, the gear 100 idles and the transmission of the torque to the driving shaft 74 is prevented. As a result, the paper 2 is prevented from being discharged by the discharge rollers 70 and 72. That is, when the discharge of the paper 2 is obstructed, stress generated by the obstruction and applied to the paper 2 is transmitted to the driving shaft 74 so that the gear 100 idles.

When such a force for preventing the rotation of the driving shaft 74 is released, the gear 100 returns from the idling state to a normal rotation due to the pressure of the coil spring 106 so that the paper 2 can be discharged.

When a load is applied to the driving shaft 74 by way of the discharge rollers 70 and 72 while the motor 80 is stopped, and if the load exceeds the pressure of the coil spring 106, mechanical coupling force between the driving shaft 74 and the motor 80 is immediately released by the torque limiter 78. As a result, the paper 2 can be drawn.

Figure 4:
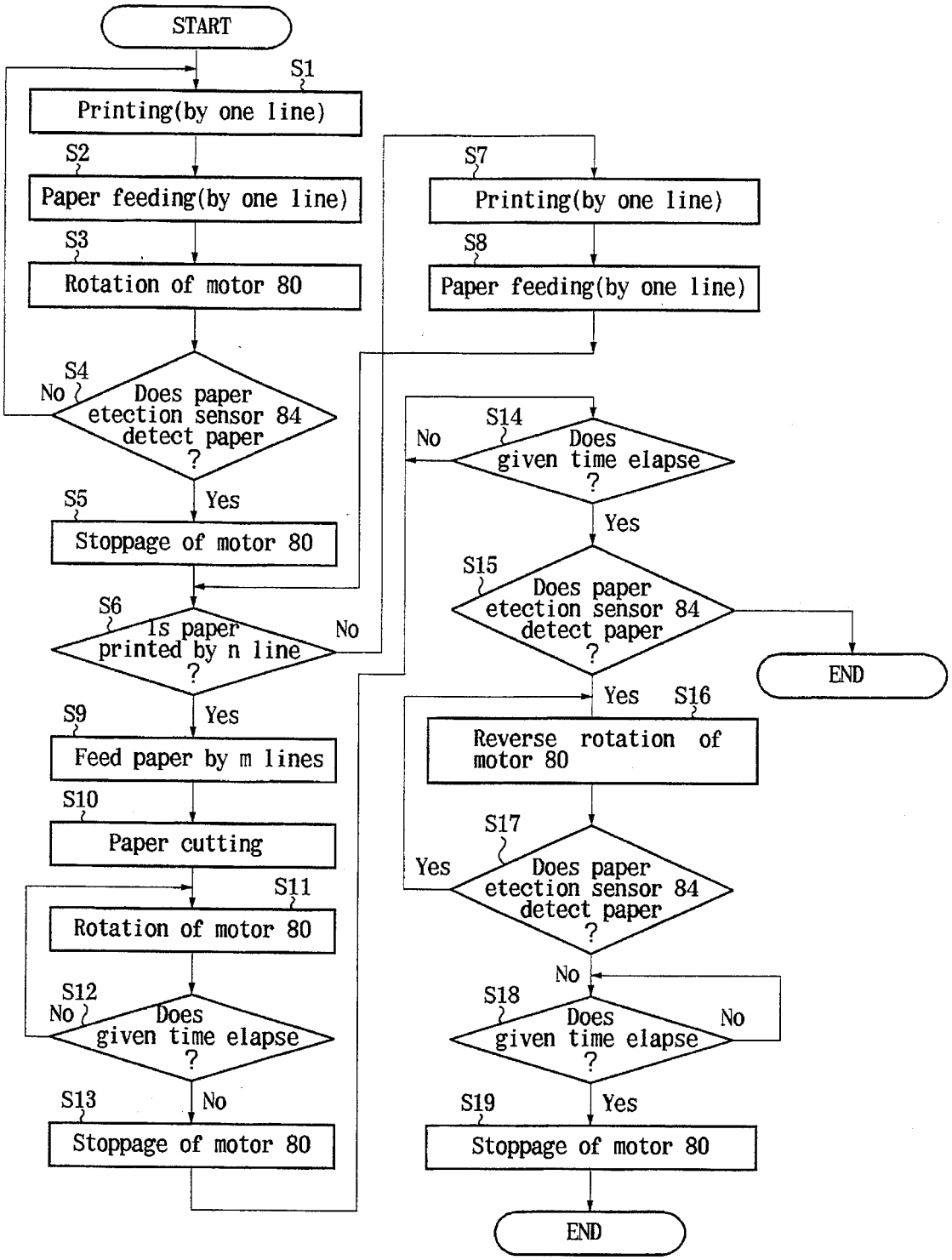
FIG. 4 is a flow chart showing a paper discharging operation.
Figure 5:
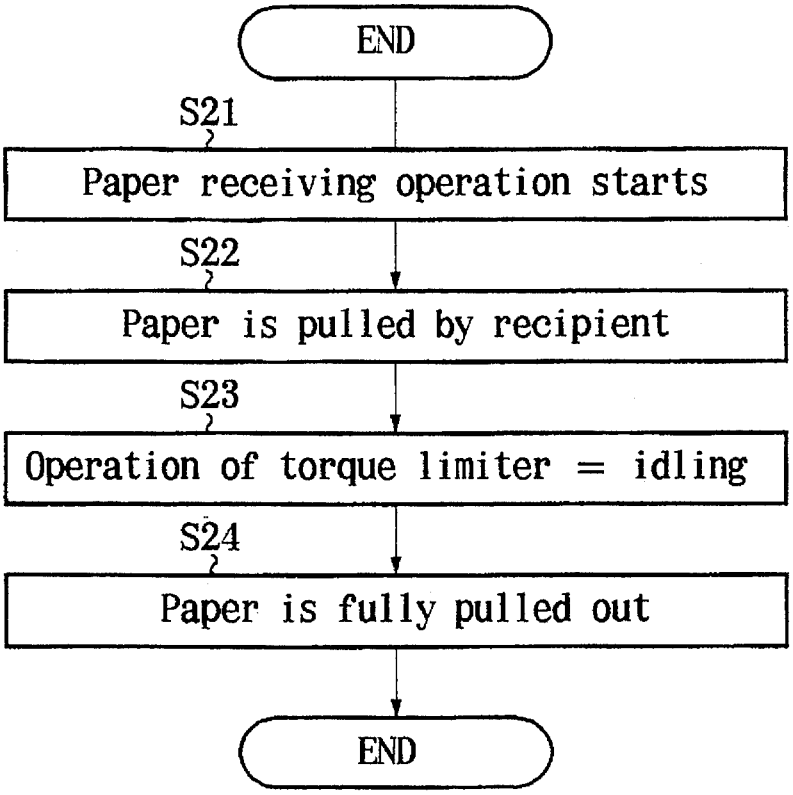
FIG. 5 is a flow chart showing a paper receiving operation by a recipient.

The operation of the paper discharge apparatus will now be described. FIG. 4 is a flow chart showing the operation of the paper discharge apparatus, and FIG. 5 shows a receiving operation of the discharged paper 2 by a recipient.

Figure 6:
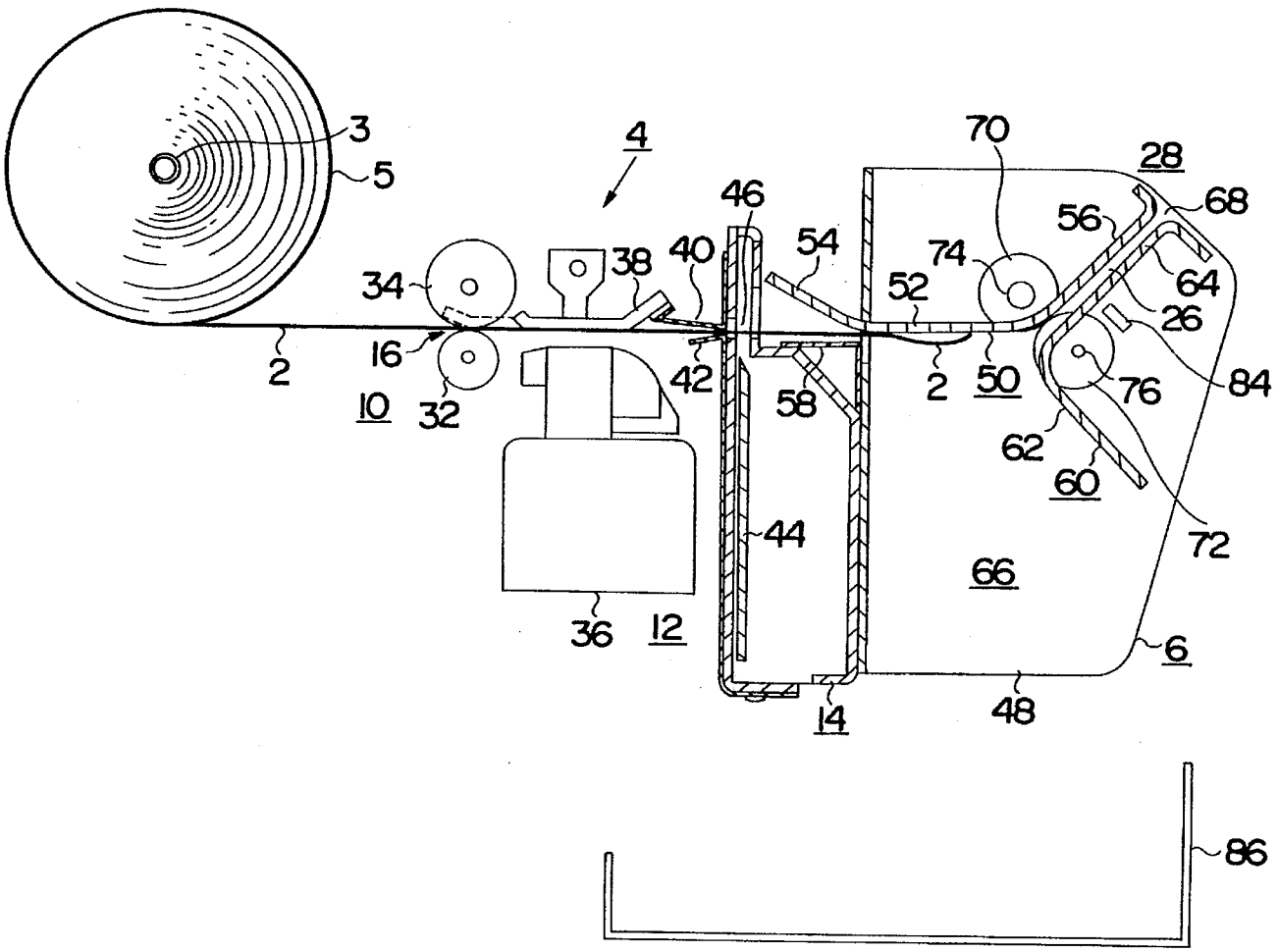
FIG. 6 is a view showing a paper discharging operation.
Figure 7:
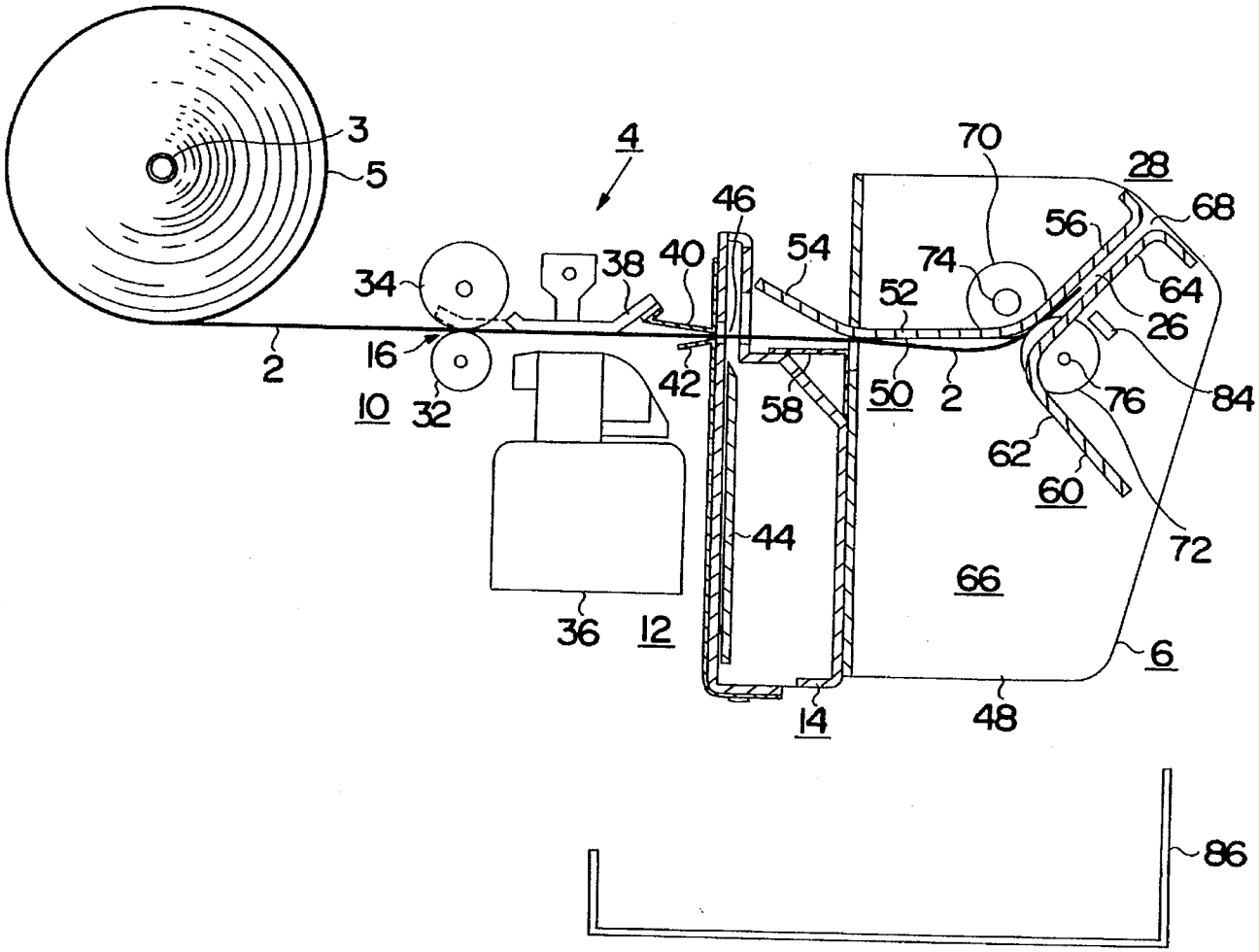
FIG. 7 is a view showing the paper discharging operation.

When print data is supplied after a power switch is turned on and the apparatus is initialized, a program goes to step S1 where the paper 2 is printed by one line. After the paper is printed by one line, the program goes to step S2 where the paper feeding operation is performed. The paper feeding operation is performed at the paper feed mechanism 10 side wherein the feeding amount of the paper 2 by one line corresponds to the printing amount of the paper 2 by one line. In step S3, the motor 80 is rotated, and the program goes to step S4. As a result, the paper detection sensor 84 detects the leading end of the paper 2 to be fed in step S4. If the paper 2 is not detected, the program returns to step S1 where the procedures in steps S1 through S4 are repeated. That is, the paper 2 to be fed is fed along the fiat portion of the discharge guide plate 50 in the paper storage portion 66 due to curling property of the role paper as shown in FIG. 6. The recipient is standby at the paper discharge port 68 side. The leading end of the paper 2 is clamped by the discharge rollers 70 and 72 as shown in FIG. 7, and it is fed to the paper discharge passage 26, and then it is detected by the paper detection sensor 84.

Figure 8:
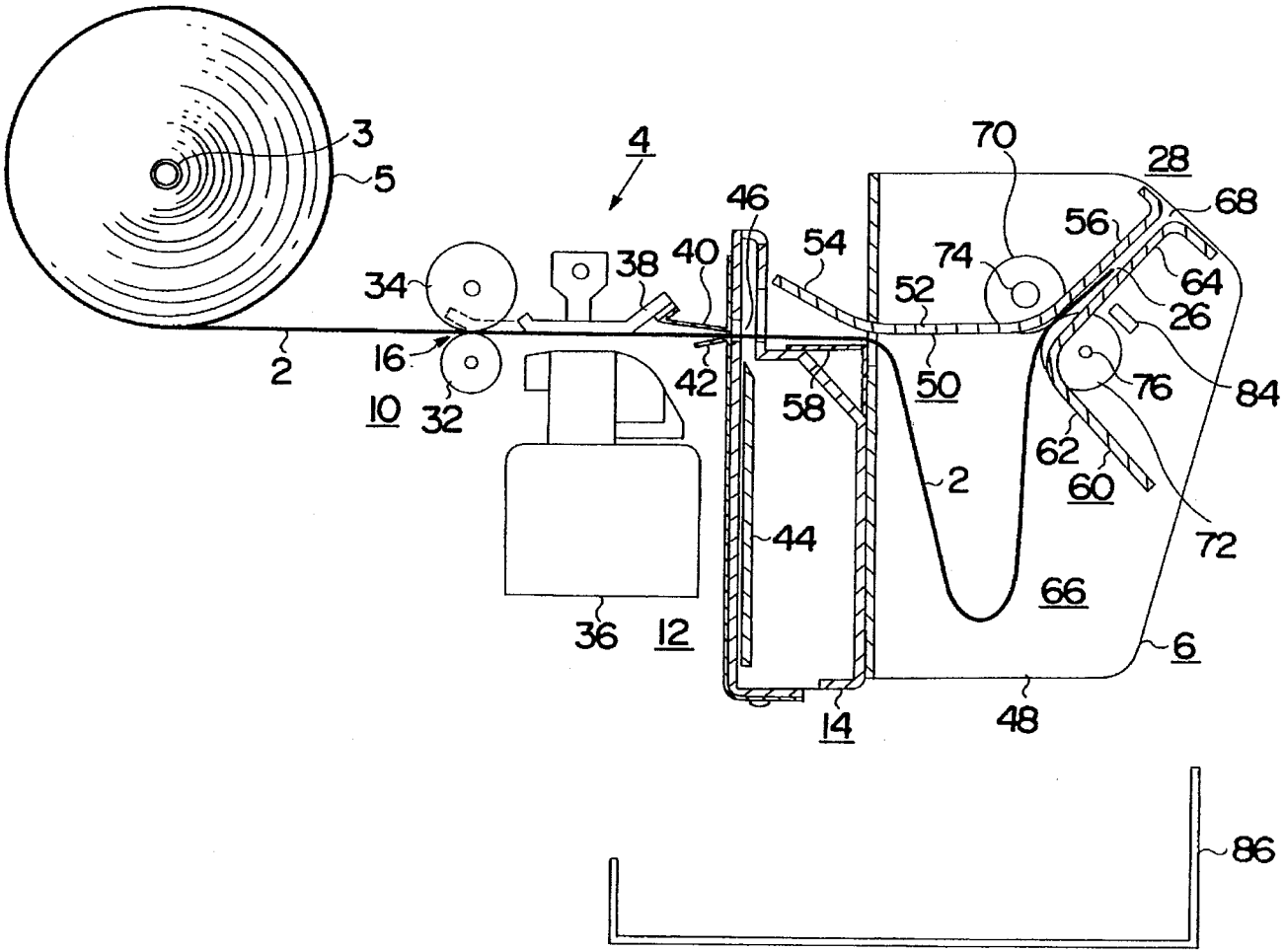
FIG. 8 is a view showing the paper discharging operation.

When the paper detecting operation is performed in step S4, the program goes to step S5 where the motor 80 is stopped. At this time, the leading end of the paper 2 is prevented from being moved in a state where it is clamped by the discharge rollers 70 and 72. The program goes to step S6 where it is judged whether the printing by n lines is completed or not. If the printing by the n lines is not completed, the program goes to step S7 where the paper 2 is printed by one line, thereafter the program goes to step S8 where the paper is fed by one line. Thereafter, the program returns to step S6 where the paper 2 is printed by the n lines. That is, as a result of feeding of the paper printed by the n lines, the paper 2 to be fed is bent inside the paper storage portion 66 owing to the curling property of the roll paper 5 and also owing to its own weight as shown in FIG. 8, and the bending amount corresponds to the feeding amount of the feed rollers 32 and 34.

Figure 9:
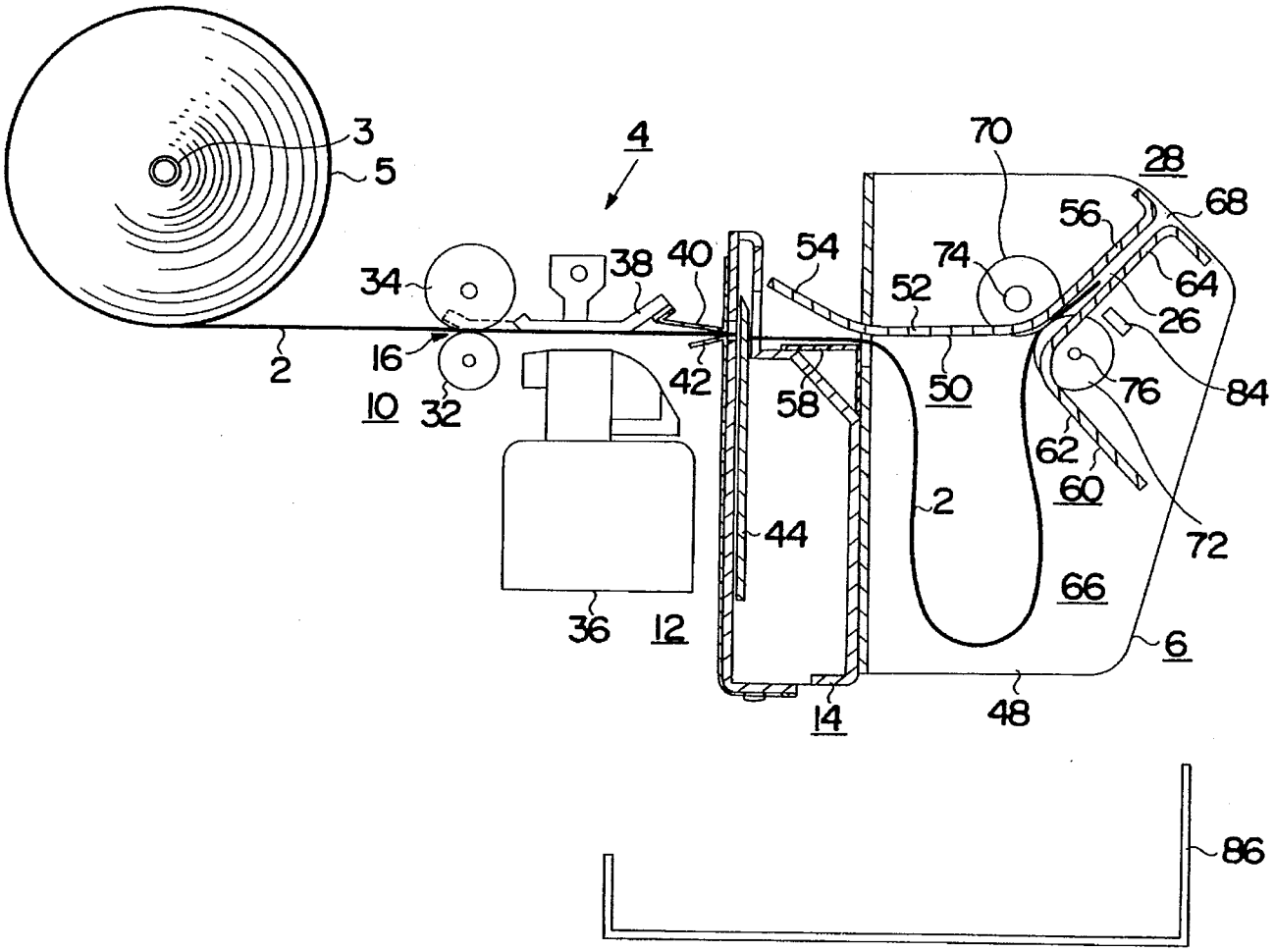
FIG. 9 is a view showing the paper discharging operation.
Figure 10:
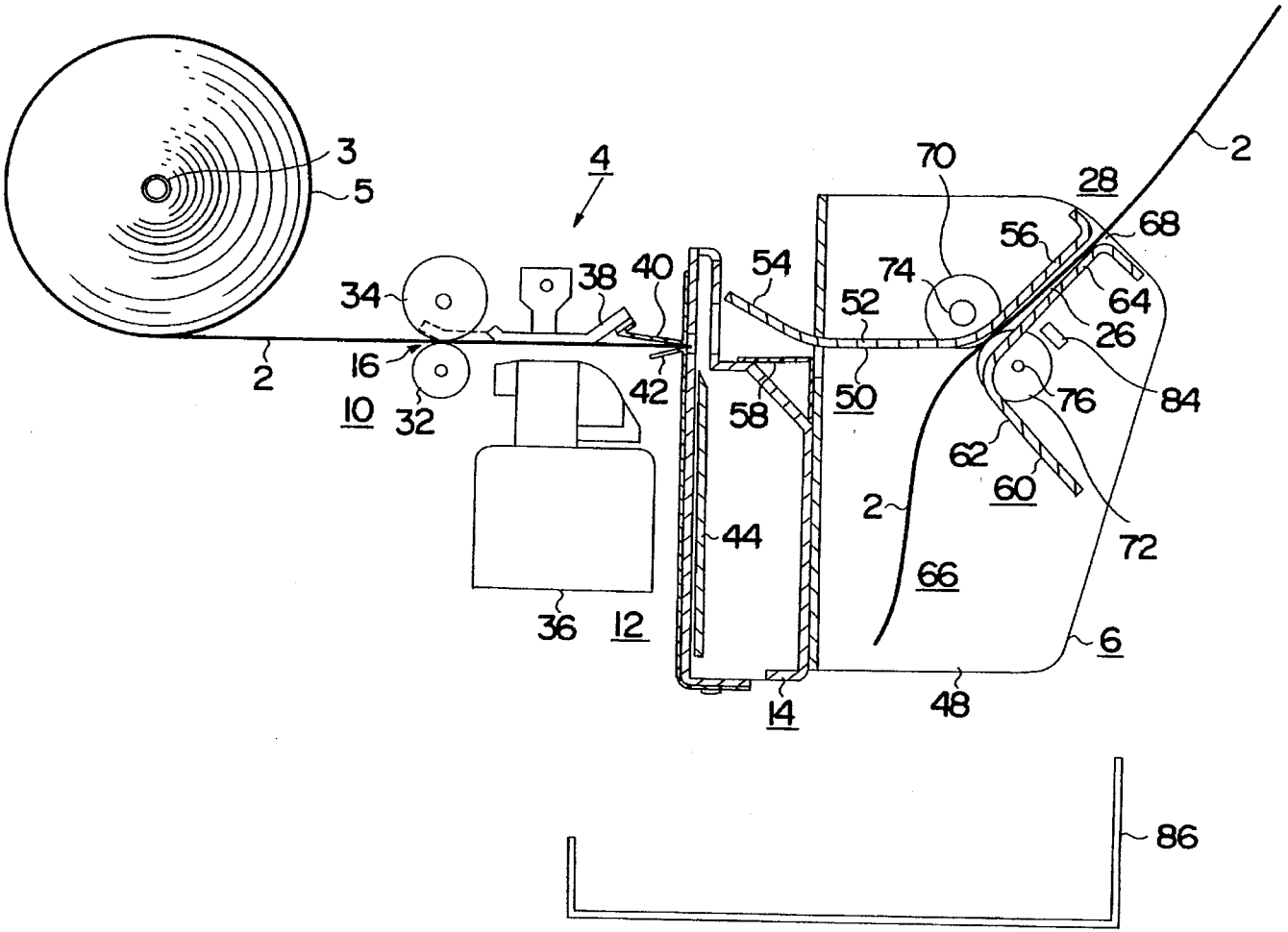
FIG. 10 is a view showing the paper discharging operation.

When the paper 2 was printed by the n lines, that is, when the paper 2 was printed so as to be served as a receipt or a ticket, the program goes to step S9 where the paper 2 is fed by m lines by the feed rollers 32 and 34. Thereafter, the program goes to step S10 where the paper 2 is cut off. In this case, as shown in FIG. 9, the cutter mechanism 14 is driven so that the cutter blade 44 rises to thereby cut off the paper 2.

After the paper 2 is cut off, the program goes to step S11 where the motor 80 is rotated, then it goes to step S12 where the driving time of the motor 80 is measured. After a given time elapses, the program goes to step S13 where the motor 80 is stopped, and the leading end of the paper 2 is discharged from the paper discharge port 68 by a given length, that is, the leading end of the paper 2 to be issued as the receipt or the ticket is discharged from the paper discharge port 68. At this time, the trailing end of the paper 2 is held by the discharge rollers 70 and 72.

Figure 11:
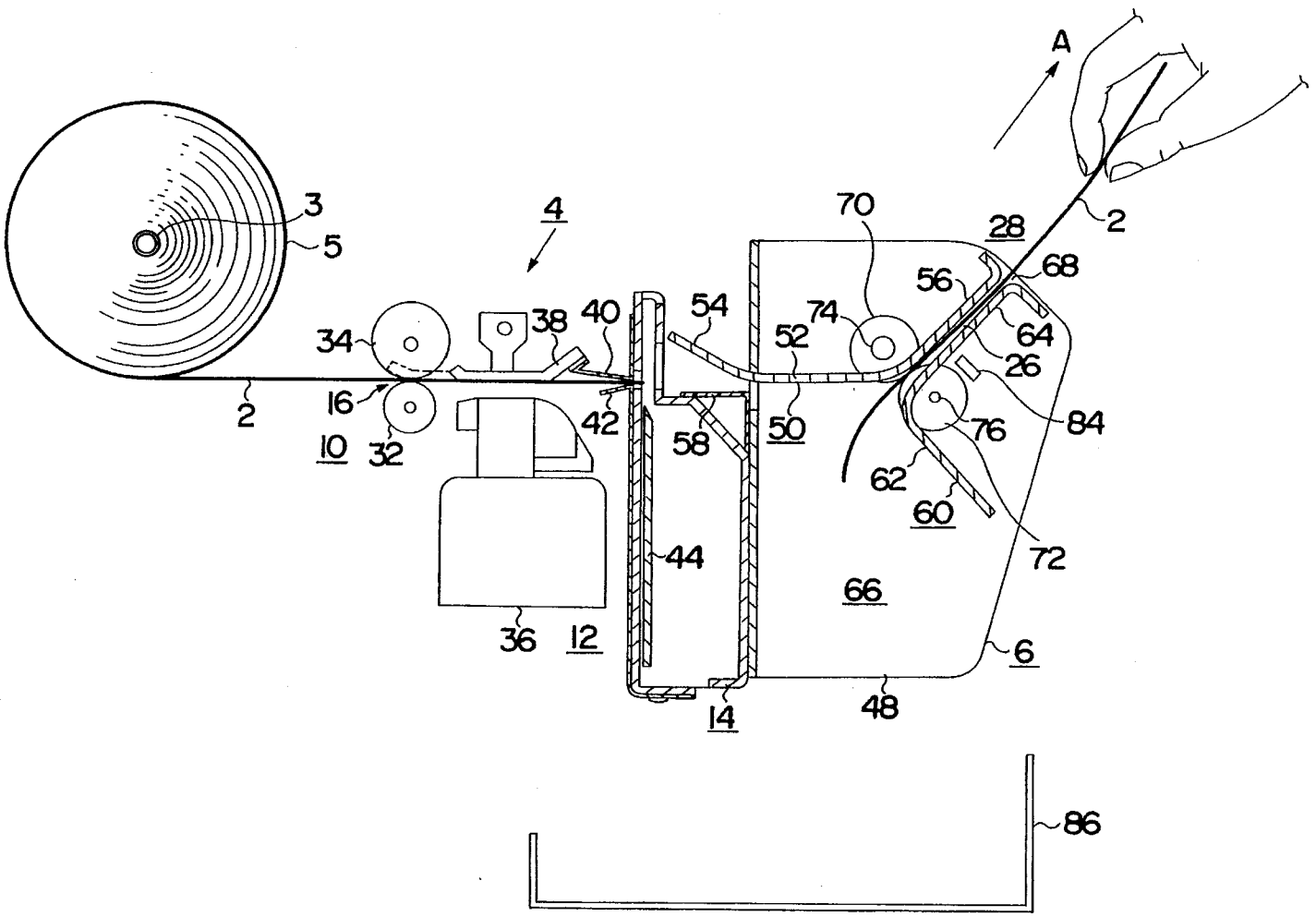
FIG. 11 is a view showing the paper discharging operation.

At this time, the recipient can pick up the leading end of the paper 2 as shown in FIG. 11. As shown in the flow chart of FIG. 5, a receiving operation of the paper 2 is started in step S21, and when the recipient pulls the paper 2, i.e., the receipt in the direction denoted by an arrow A while picking it up, the program goes to Step S23 where the operation of the torque limiter 78 is started, namely, the torque limiter 78 idles. The cut paper 2 is pulled out by the recipient in step S24.

Figure 12:
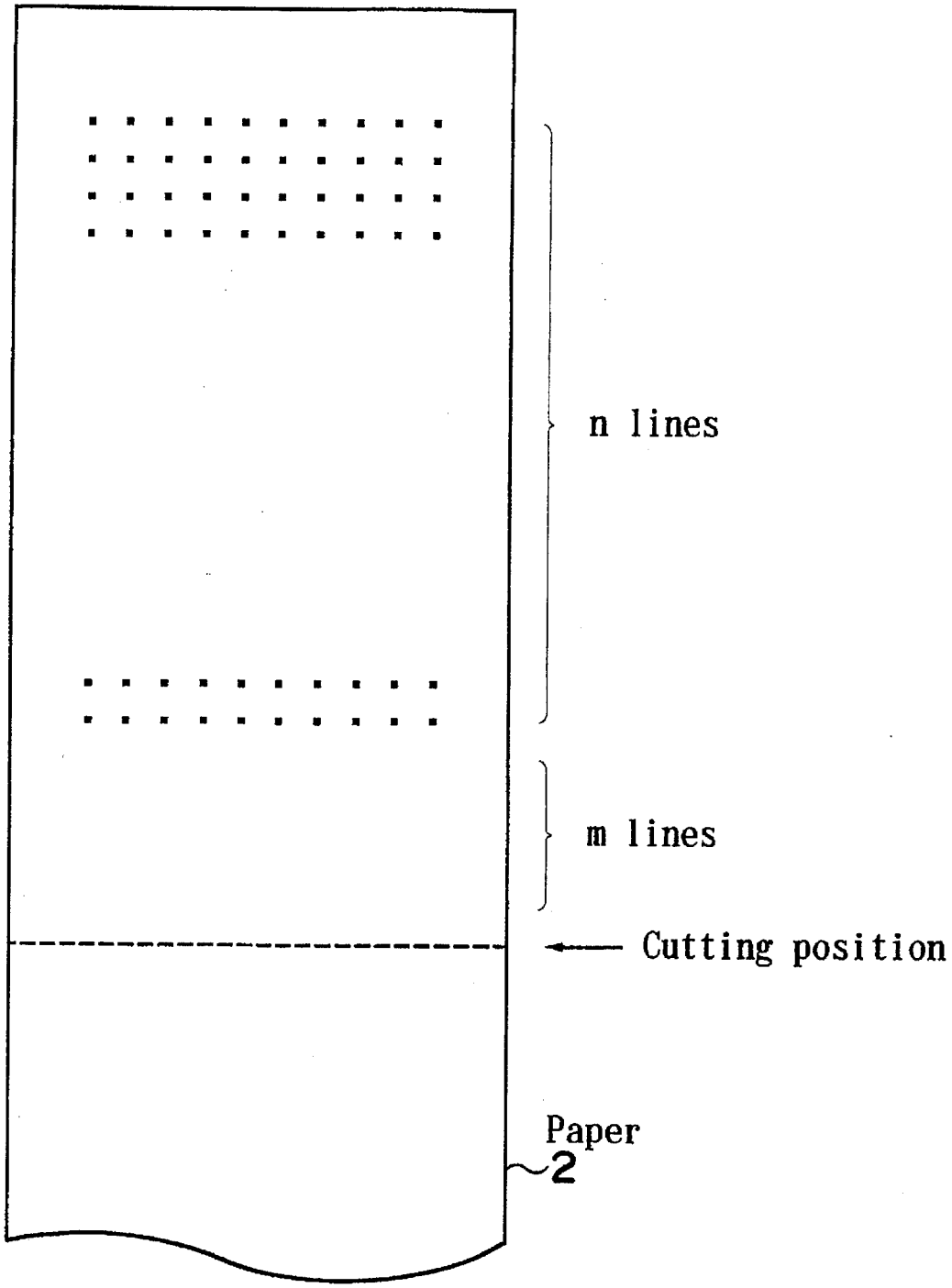
FIG. 12 is a plan view of a paper.

FIG. 12 shows the paper 2 to be discharged as the receipt or the ticket wherein the n lines represent a blank portion which is to be printed by the n lines and the m lines represent a blank portion which is to be discharged by the m lines, and 200 represents a cutting position.

Figure 13:
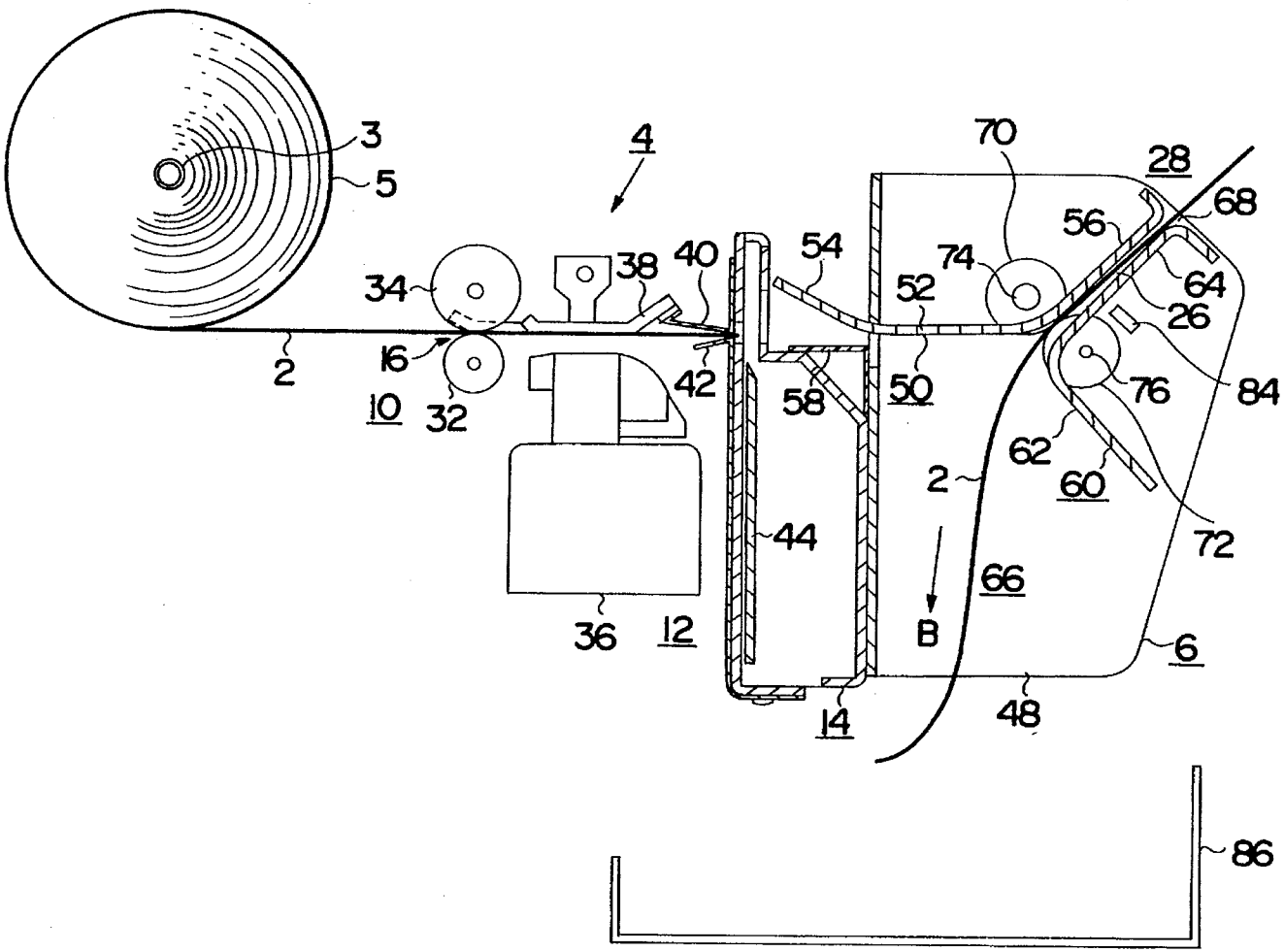
FIG. 13 is a view showing a paper collecting operation.

As shown in FIG. 13, when the recipient rejects to receive the paper 2 or forgets to receive the paper 2 and leaves the apparatus although the paper 2 is discharged from the paper discharge port 68 in a normal operation of the paper discharge apparatus, the paper 2 remains in the paper discharge port 68. That is, a given time is measured in step S14 in FIG. 4.

Figure 14:
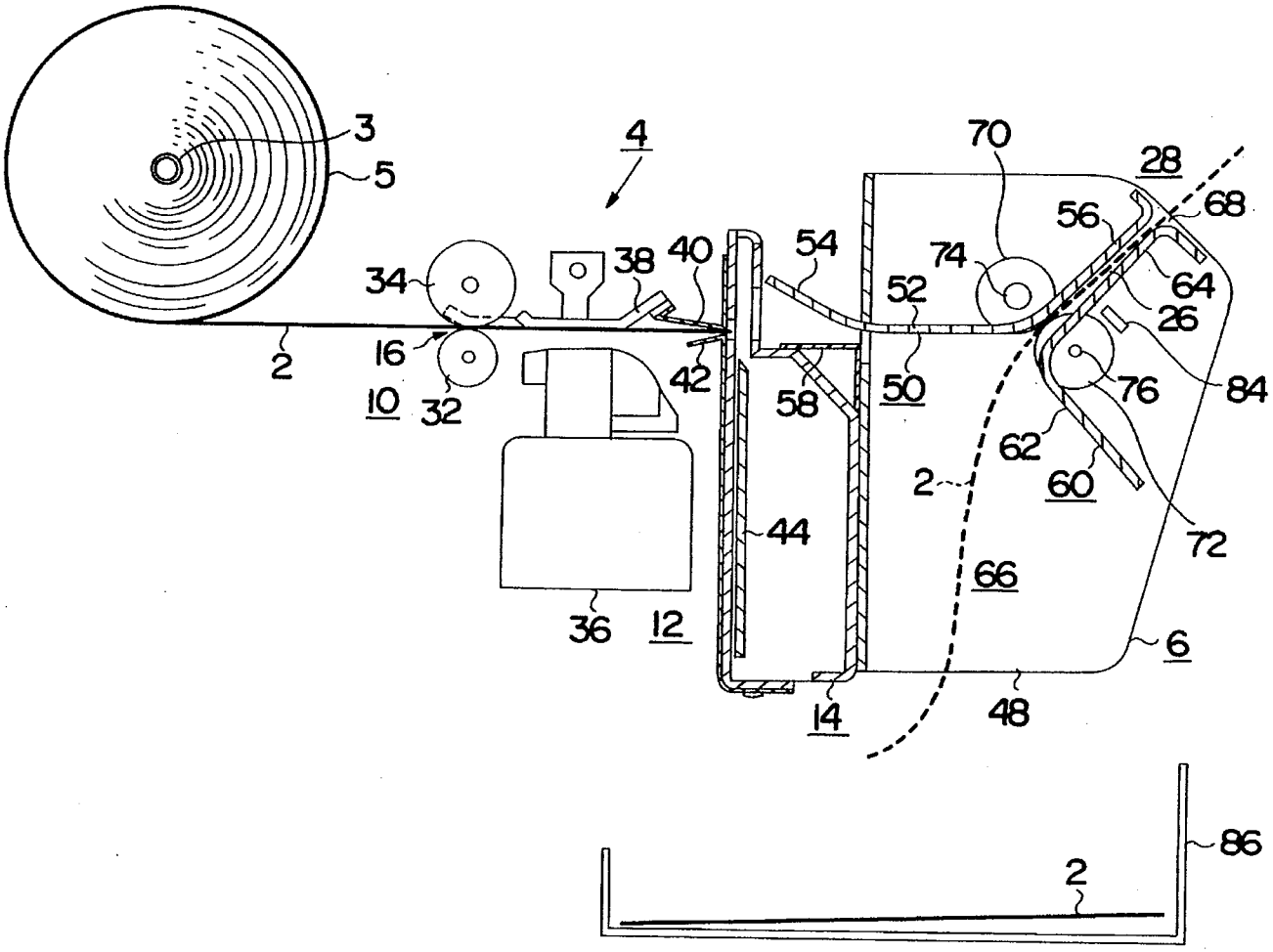
FIG. 14 is a view showing the paper collecting operation.

This given time is a standby time considering the time necessary for the receiving operation of the paper 2. When this given time elapses, the paper detecting operation is performed by the paper detection sensor 84. At this time, if the paper 2 is not detected, the normal paper discharging operation, namely, the issuing operation of the receipt or the ticket is performed as mentioned above, so that the paper discharging operation is completed. However, if the paper detection sensor 84 detects that the paper 2 remains not removed, the program goes to step S16 where the motor 80 is reversely rotated, so as to start the paper collecting operation. At this time, as shown in FIG. 13, the paper 2 is fed from the paper storage portion 66 to the collection tray 86 in the direction denoted by an arrow B owing to the reverse rotation of the discharge rollers 70 and 72. In step S17, the detecting operation of the paper 2 is performed. That is, the reverse rotation of the motor 80 continues until the paper 2 is collected in the collection tray 86. The paper 2 is collected in the collection tray 86 as shown in FIG. 14.

When the paper 2 is not present in step S17, the program goes to step S18 where it is judged whether a given time elapses or not. This given time is, for example, a time necessary for the paper to move away from or leave the discharge rollers 72 and 74.

When the given time elapses in step S18, the program goes to step S19 where the motor 80 is stopped so as to complete the collecting operation, and is standing by for the next issuing operation of the paper 2.

Figure 15:
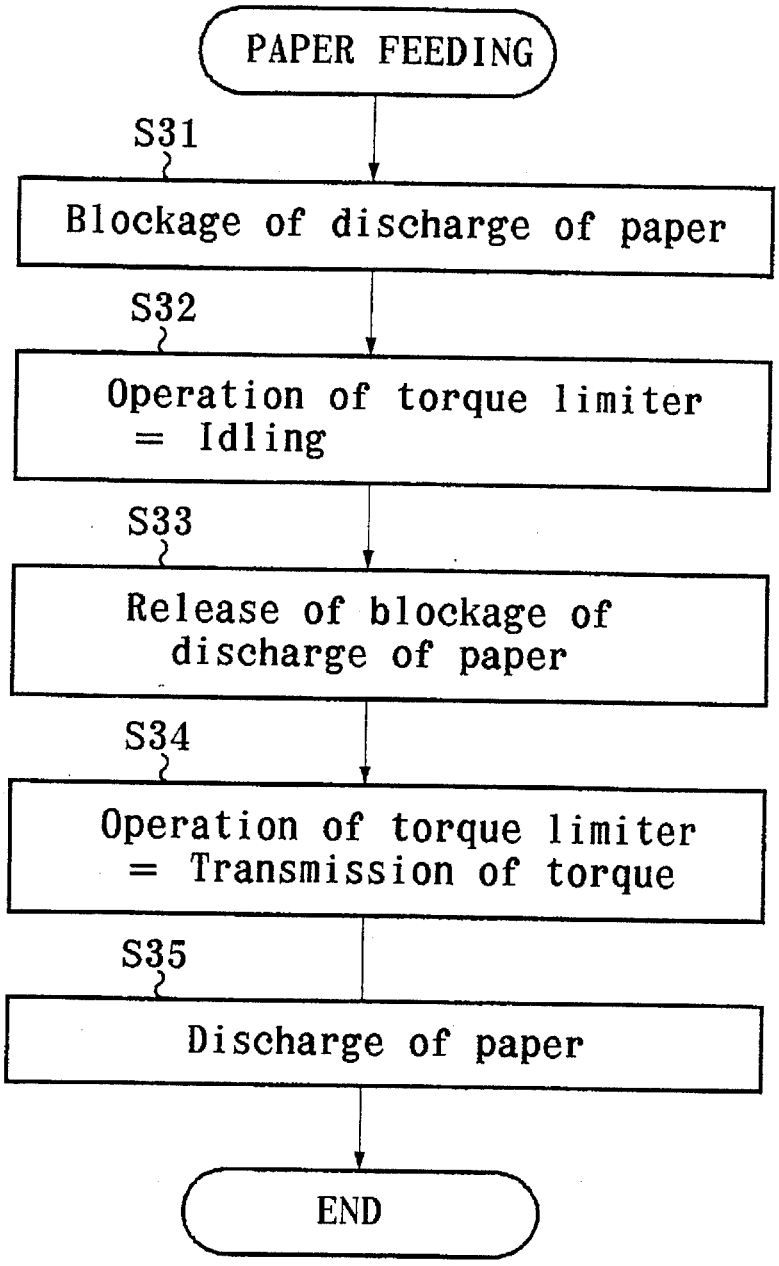
FIG. 15 is a flow chart showing an operation when the discharge of the paper is blocked.
Figure 16:
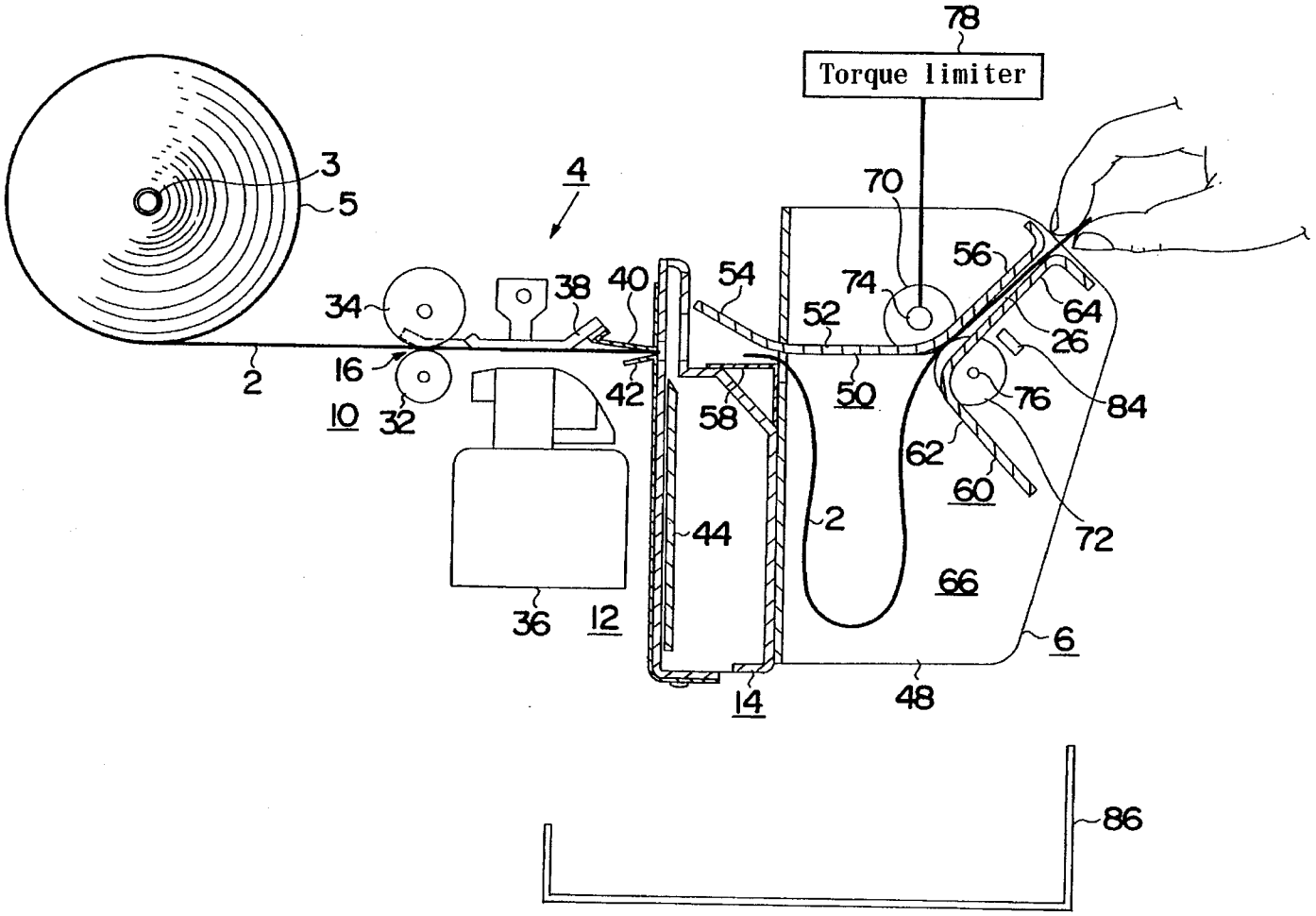
FIG. 16 is a view showing the operation when the discharge of the paper is blocked.

FIG. 15 is a flow chart showing the operation when the paper discharge is blocked, for example, when the paper discharge port 68 is blocked during the paper issuing operation. In step S31, for example, when the paper discharge port 68 is blocked, thereby preventing the paper 2 from being discharged, a mechanical stress influencing the paper 2 acts upon the torque limiter 78 so that the torque limiter 78 idles, and hence the rotation of the discharge rollers 70 is stopped. As a result, the discharge of the paper 2 is stopped, thereby preventing occurrence of paper jam caused by ignorance or mischief of the recipient. When the blockage of the paper 2 is released as shown in step S33, release of the stress acts upon the torque limiter 78, then the program goes to step S34 where the torque limiter 78 is changed again to a torque transmission state, whereby the paper 2 is normally discharged in step S35.

With the provision of the torque limiter 78, the driving force, which does not influence printing accuracy of the printer mechanism 4, can be set to the discharge rollers 70. Furthermore, if the feeding speed of the paper 2 from the printer mechanism 4 is not the same as the discharging speed of the paper, a force involved in the discharge of the paper can be absorbed by the torque limiter 78, thereby preventing occurrence of the paper jam beforehand.

Figure 17:
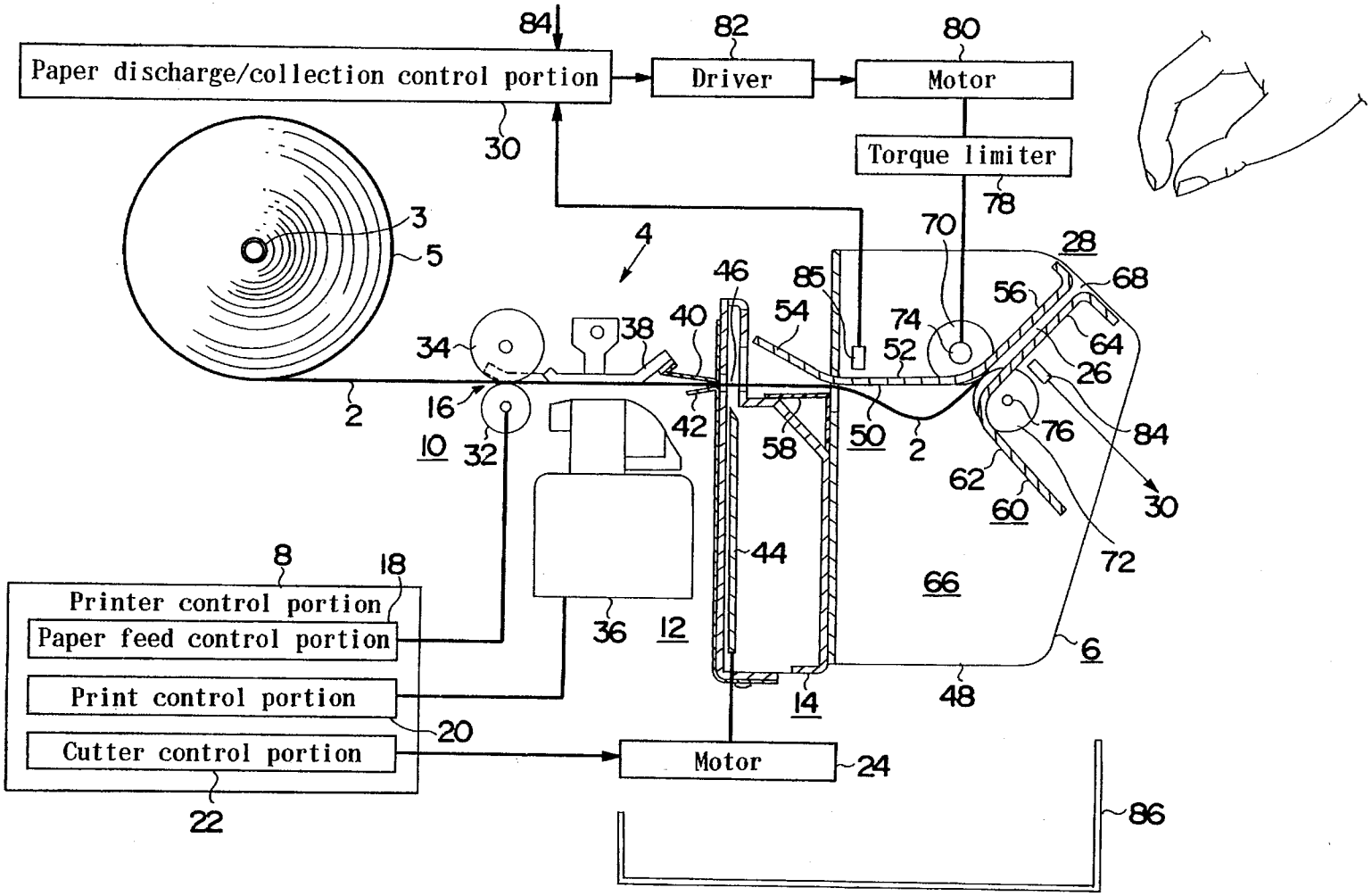
FIG. 17 is a view of a paper discharge apparatus according to a second embodiment of the invention.

Second embodiment (FIGS. 17 through 19):

A paper discharge apparatus according to a second embodiment of the invention will be described now with reference to FIGS. 17 through 19.

Elements which are the same as those of the first embodiment are denoted by the same numerals.

The paper discharge apparatus includes the paper detection sensor 84 disposed at the paper discharge passage 26 side as a first paper detection means so as to detect the presence of the paper 2 to be discharged, and another paper detection sensor 85 disposed at the horizontal portion 52 side of the first discharge guide plate 50 as a second paper detection means so as to detect the passage of the trailing end of the paper 2. The operation in this case is illustrated in a flow chart of FIG. 18. In the flow chart of FIG. 18, step S4 in FIG. 4 is replaced by step S4' where the leading end of the paper 2 is detected by the paper detection sensor 84, and step S12 in FIG. 4 is replaced by step S 12' where the trailing end of the paper 2 is detected by the paper detection sensor 85. When the trailing end of the paper 2 is detected by the paper detection sensor 85, it hangs toward the collection tray 86 side from the paper storage portion 66. In the second embodiment, the paper collecting operation is performed after a given time elapses upon completion of the discharge of the paper 2.

When the paper discharging operation is continued until the trailing end of the paper 2 to be discharged is detected by the paper detection sensor 85, it is not affected by the length of the paper 2 so as to realize assured paper discharging operation. Although it is necessary to set the feeding time beforehand so as to allow the trailing end of the paper 2 to hang toward the collection tray 86 when the paper discharging operation is performed during a given time in the same manner as the first embodiment, such a trouble for setting the time is omitted, and further it is not necessary to set the feeding time considering the length of the paper 2 if the trailing end of the paper 2 is detected. When the paper discharging operation is performed after the paper discharge port 68 is blocked, the trailing end of the paper 2 can be positioned surely at the collection tray 86 side. Further, when the load applied to the paper 2 on the paper feed passage 16 is increased, the paper discharging operation can be continued until the trailing end of the paper 2 is detected by the paper detection sensor 85, thereby assuring the paper discharging operation. Although it is necessary to set the feeding time relatively longer, and particularly to vary the time for every apparatus considering the variation of the motor 80 in properties, such troublesome time setting is not required if the arrival of the trailing end of the paper 2 is detected, so that the properties of the apparatus can be complimented to thereby enhance the reliability of the control.

Figure 18:
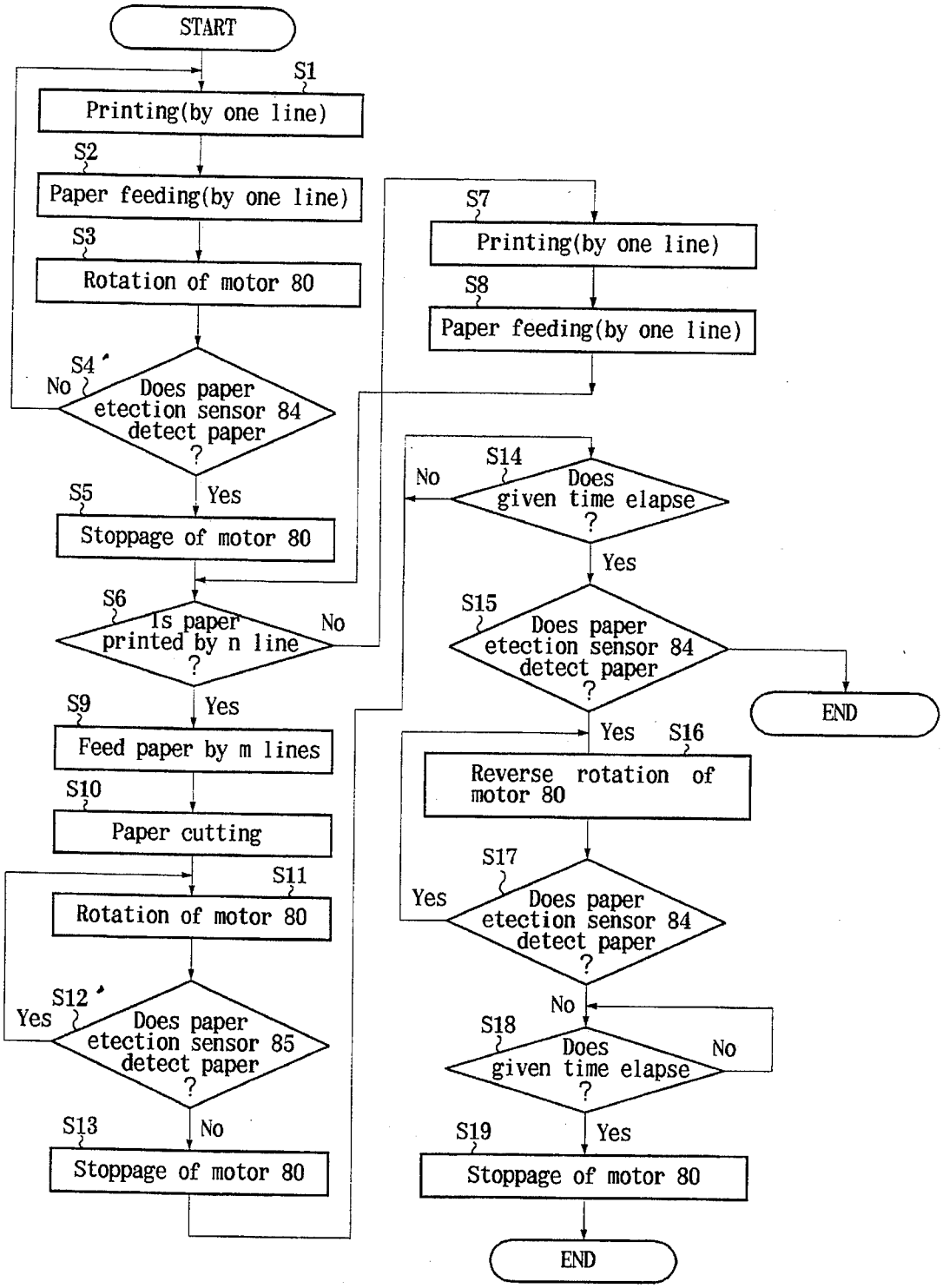
FIG. 18 is a flow chart showing a paper discharging operation according to the second embodiment.
Figure 19:
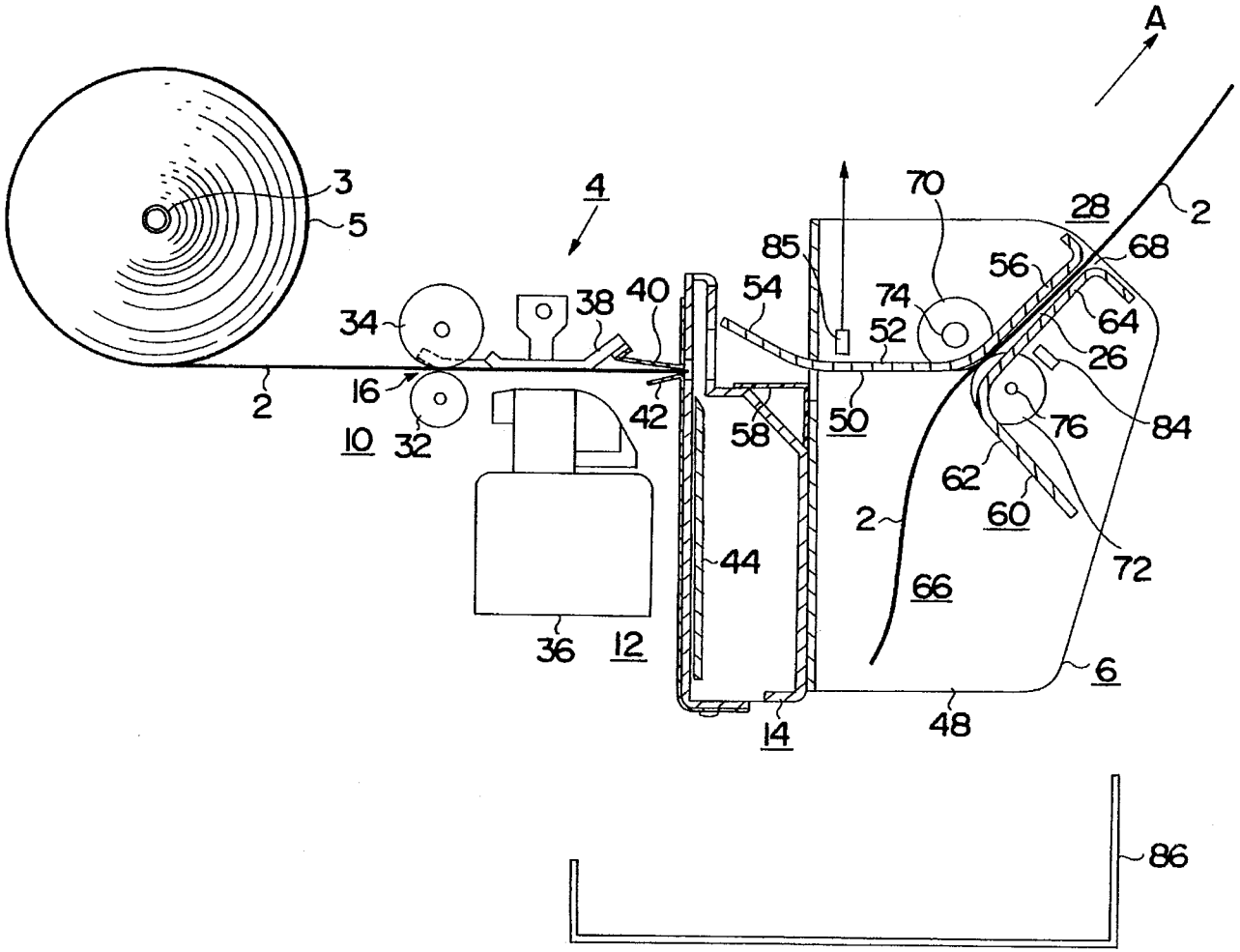
FIG. 19 is a view showing a paper receiving operation.
Figure 20A:
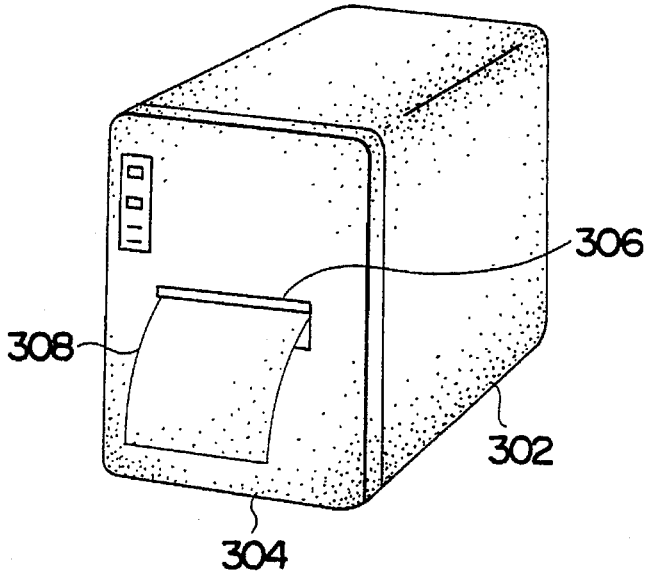
PRIOR ART FIG. 20A
FIG. 20A is a perspective view showing an external appearance of a conventional printer.
Figure 20B:
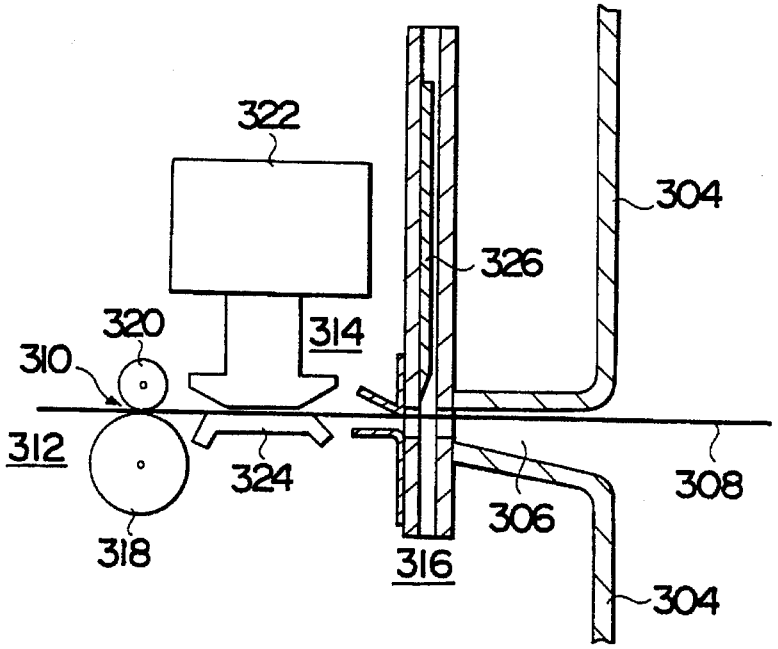
PRIOR ART FIG. 20B
FIG. 20B is a cross-sectional view of an internal structure of the printer in FIG. 20A.
Figure 21:
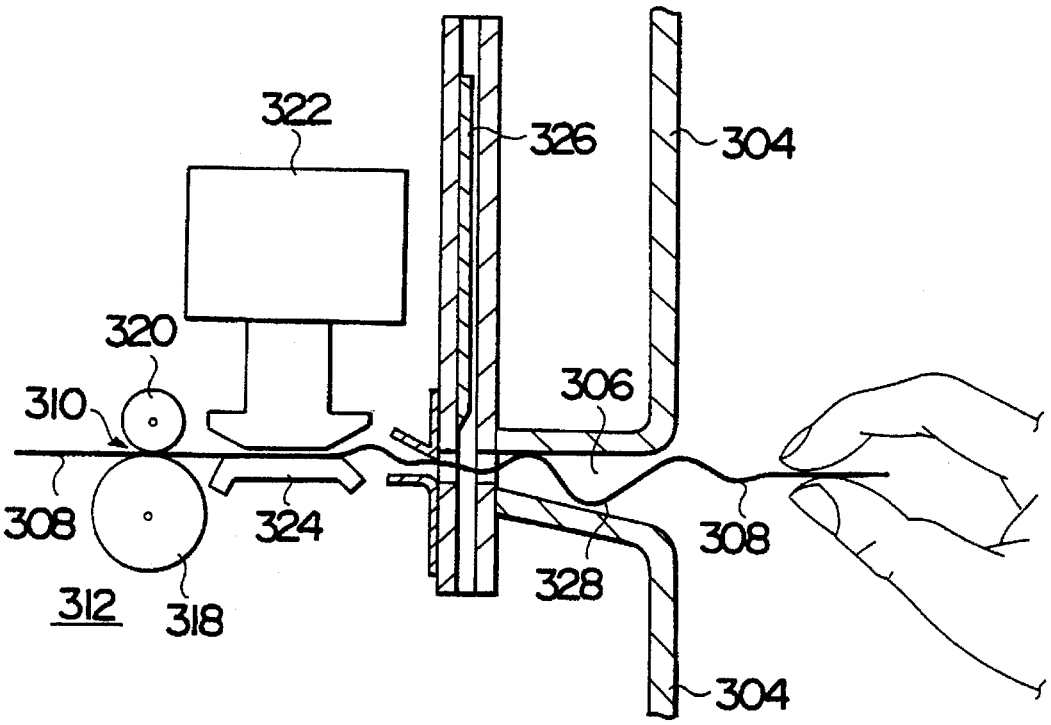
PRIOR ART FIG. 21
FIG. 21 is a cross-sectional view of the printer in FIG. 20B showing a standby state of a paper discharging operation.
Figure 22A:
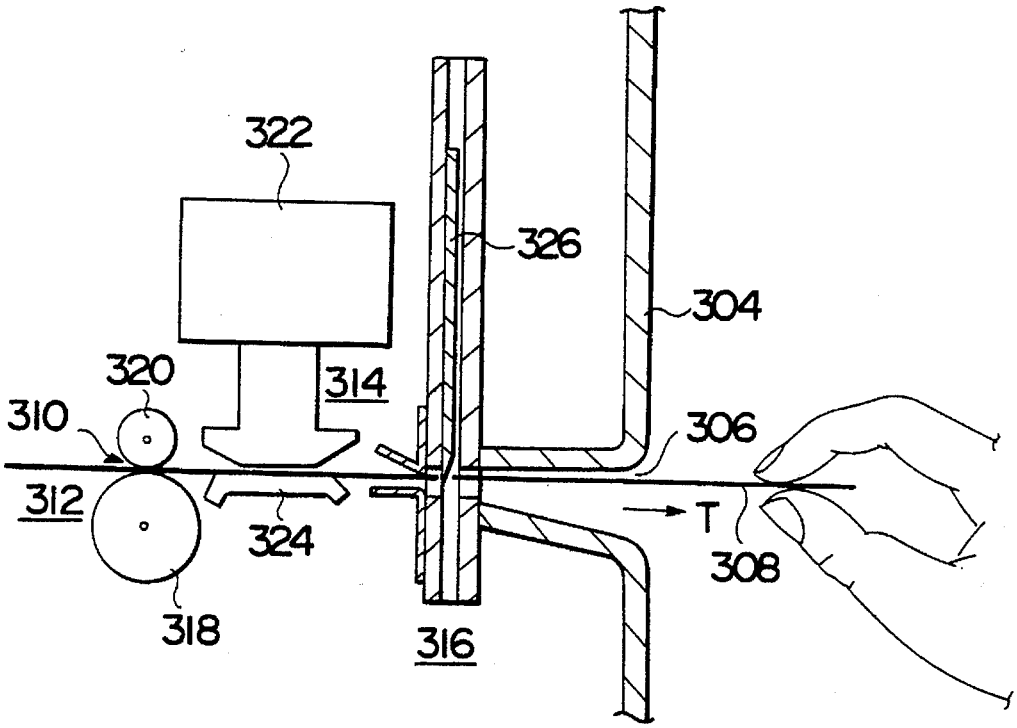
PRIOR ART FIG. 22A
FIG. 22A is a cross-sectional view of the printer in FIG. 20B showing a state where tension is applied to a paper when the paper to be discharged is cut off.
Figure 22B:
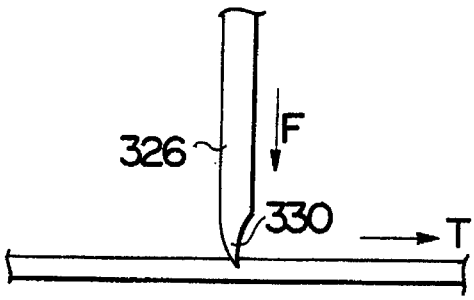
PRIOR ART FIG. 22B
FIG. 22B is a view showing an edge of a cutter which is deformed by tension applied to the paper to be discharged.

In the flow charts as shown in FIG. 4 or FIG. 18, after the given time elapses in step S14, the paper detecting operation is performed by the paper detection sensor 84 in step S15. However, even if step S14 is replaced by step S15, namely, even if the program is executed so as to judge whether a given time elapses or not upon completion of the paper detecting operation by the paper detection sensor 84, the same effect as the first embodiment can be expected.

Although the paper collecting operation is exemplified based on the detection of the leading end of the paper according to the first and second embodiments of the invention, the present invention is not limited to such embodiments. The object for performing the paper collecting operation is to collect the paper in the apparatus when the recipient forgets or rejects to receive the paper. The paper collecting operation can be started based on the time when the apparatus starts its operation or may be based on the time when the paper discharging operation is started upon completion of the printing operation. The paper collecting operation may be started based on the time when a given time elapses from the time when a paper detection means detects the motion or presence of the paper by providing such a paper detection means.

As mentioned above, the following effects can be obtained by the present invention.

a. Since the paper is collected in the apparatus even if the recipient rejects or forgets to receive the issued paper, it is possible to surely prevent the operational difficulties caused by the paper remaining in the apparatus, thereby performing the stable issuing operation. When a cash dispenser, an information terminal apparatus, etc., are installed in an unmanned shop, the issued ticket, receipt, etc., can be collected, thereby realizing the stable and continuous operation, and preventing the paper from remaining to be left, so that an unexpected accident can be prevented beforehand.

b. The paper discharge apparatus contributes to reduction of the paper collecting operation by an operator when the discharged paper is left in the apparatus.

c. The paper issuing operation and the paper collecting operation are speeded up.

Although the present invention is explained with reference to the first and second embodiments, it is not limited to these embodiments but includes various modifications for realizing the object of the present invention. Further, it is expected that the present invention can be utilized in a mechanism or an apparatus for discharging a piece of paper such as the ticket, the receipt, etc. without printing and cutting off the paper which is different from the apparatus as mentioned in the prior art and the present embodiments.

What is claimed is:

1. A paper discharge apparatus for discharging an arbitrarily cut paper from a paper discharge port comprising:

a paper feed means for feeding said paper;

a paper discharge means provided with paper discharge rollers for discharging said paper fed by said paper feed means to said paper discharge port;

a paper storage means for bending and storing said paper in said apparatus by operating said paper feed means alone while stopping a discharging operation of said paper discharge means when said paper fed by said paper feed means is delivered to said paper discharge means in a paper discharge mode; and a paper collection means for collecting said paper in said apparatus when said paper discharged to said paper discharge port by said paper discharge means after said paper is stored in said paper storage means is not removed.

2. A paper discharge apparatus according to claim 1, wherein said paper collection means performs a collecting operation for collecting said paper in said apparatus by reversely rotating said paper discharge rollers of said paper discharge means when a given time elapses upon completion of said paper discharging operation by said paper discharge means.

3. A paper discharge apparatus according to claim 1 further comprising a paper detection means for detecting said paper discharged to said paper discharge port by said paper discharge means, wherein said paper collection means collects said paper in said apparatus by reversely rotating said paper discharge rollers of said paper discharge means when a given time elapses upon completion of detection of said paper by said paper detection means while said paper is detected.

4. A paper discharge apparatus according to claim 1 further comprising a paper detection means for detecting a leading end of said paper discharged to said paper discharge port by said paper discharge means, wherein said paper collection means collects said paper in said apparatus by reversely rotating said paper discharge rollers of said paper discharge means when a given time elapses upon completion of detection of said leading end of said paper by said paper detection means while said paper is detected.

5. A paper discharge apparatus according to claim 1, wherein said paper collection means has a paper collection tray under said paper discharge means so as to collect said paper which is drawn in said apparatus by said discharge rollers when they are reversely rotated and drops in said apparatus by its own weight.

6. A paper discharge apparatus according to claim 1, wherein said paper discharge port is formed over said paper discharge means.

7. A paper discharge apparatus according to claim 1, wherein said discharge rollers of said paper discharge means comprises a pair of upper and lower paper discharge rollers, said lower discharge rollers being displaced to said paper discharge port side relative to said upper discharge rollers.

8. A paper discharge apparatus for discharging an arbitrarily cut paper from a paper discharge port comprising:

a paper discharge means provided with discharge rollers for discharging said paper to said paper discharge port;

a first paper detection means for detecting a leading end of said paper discharged to said paper discharge port by rotation of said discharge rollers;

a second paper detection means disposed at a paper storage portion side for detecting a trailing end of said paper discharged to said discharge port by rotation of said discharge rollers; and a paper collection means for stopping said discharge rollers when said second paper detection means detects said trailing end of said paper while said paper is discharged, and for reversely rotating said discharge rollers to collect said paper in said paper discharge apparatus when a given time elapses after stoppage of said discharge rollers while said first paper detection means detects said paper.

9. A paper discharge apparatus according to claim 8 wherein said paper collection means has a paper collection tray under said paper discharge means so as to collect said paper which is drawn in said apparatus by said discharge rollers when they are reversely rotated and drops in said apparatus by its own weight.

10. A paper discharge apparatus according to claim 8, wherein said paper discharge port is formed over said paper discharge means.

11. A paper discharge apparatus according to claim 8, wherein said discharge rollers of said paper discharge means comprises a pair of upper and lower paper discharge rollers, said lower discharge rollers being displaced to said paper discharge port side relative to said upper discharge rollers.

* * * * *